US006801220B2

(12) United States Patent
Greier et al.

(10) Patent No.: US 6,801,220 B2
(45) Date of Patent: Oct. 5, 2004

(54) METHOD AND APPARATUS FOR ADJUSTING SUBPIXEL INTENSITY VALUES BASED UPON LUMINANCE CHARACTERISTICS OF THE SUBPIXELS FOR IMPROVED VIEWING ANGLE CHARACTERISTICS OF LIQUID CRYSTAL DISPLAYS

(75) Inventors: Paul F. Greier, Carmel, NY (US); Kenneth C. Ho, Yonkers, NY (US); Richard Ian Kaufman, Somers, NY (US); Steven Edward Millman, Spring Valley, NY (US); Gerhard R. Thompson, Wappingers Falls, NY (US); Steven L. Wright, Cortlandt Manor, NY (US); Chai Wah Wu, Poughquag, NY (US)

(73) Assignee: International Business Machines Corporation, Armonk, NY (US)

( * ) Notice: Subject to any disclaimer, the term of this patent is extended or adjusted under 35 U.S.C. 154(b) by 405 days.

(21) Appl. No.: 09/771,323

(22) Filed: Jan. 26, 2001

(65) Prior Publication Data

US 2002/0149598 A1 Oct. 17, 2002

(51) Int. Cl.[7] ..... G09G 5/02; G09G 5/10; G09G 3/20

(52) U.S. Cl. ..... 345/694; 345/55; 345/690

(58) Field of Search ..... 345/589, 591, 345/613, 690, 597, 600, 601, 602, 63, 77, 50, 87, 596, 697, 694, 698, 209, 55

(56) References Cited

U.S. PATENT DOCUMENTS

| | | | | |
|---|---|---|---|---|
| 5,016,191 A | | 5/1991 | Radochonski | |
| 5,254,982 A | | 10/1993 | Feigenblatt et al. | |
| 5,489,917 A | | 2/1996 | Ikezaki et al. | |
| 5,489,918 A | * | 2/1996 | Mosier | 345/89 |
| 5,703,621 A | | 12/1997 | Martin et al. | |
| 5,774,112 A | * | 6/1998 | Kasson | 345/153 |
| 5,847,688 A | | 12/1998 | Ohi et al. | |
| 5,969,700 A | * | 10/1999 | Fitzgibbons et al. | 345/87 |
| 6,034,663 A | * | 3/2000 | Killebrew et al. | 345/596 |
| 6,236,390 B1 | * | 5/2001 | Hitchcock | 345/694 |
| 6,384,837 B1 | | 5/2002 | Lee | 345/589 |
| 6,392,657 B1 | | 5/2002 | Hilliard | 345/589 |
| 6,396,505 B1 | * | 5/2002 | Lui et al. | 345/613 |
| 6,469,684 B1 | * | 10/2002 | Cole | 345/58 |
| 6,498,592 B1 | * | 12/2002 | Matthies | 345/1.1 |
| 6,624,828 B1 | * | 9/2003 | Dresevic et al. | 345/771 |

OTHER PUBLICATIONS

240–Channel 61–Bit Source Driver for Color TFT LCDS, MPT57481, Texas Instruments, Dallas, Texas 75265, pp. 1–29, SGLS099–Mar. 1997/.

192/200–Output TFT Gate Driver, MPT57604, Texas Instruments, Dallas, Texas 75265, pp. 1–9,, SGLS109–Jan. 2000.

Pending Patent Application YOR92000354US1, entitled, Method and System for Error Diffusion with a Plurality of Error Measures:, filed Jan. 31, 2001.

(List continued on next page.)

*Primary Examiner*—Mark Zimmerman
*Assistant Examiner*—Scott Wallace
(74) *Attorney, Agent, or Firm*—Robert M. Trepp

(57) ABSTRACT

Viewing angle characteristics of a liquid crystal display (LCD) are improved by reducing the number of subpixels in an image with mid-tone luminance values. In a preferred embodiment, a first table of entries associating subpixel intensity values and subpixel luminance values for a LCD in at least one viewing angle direction is provided. A target intensity value is determined from the first table, corresponding to the average subpixel luminance over a small number of adjacent subpixels. A second table of entries associates the target intensity values with intensity values above and below the target. The adjacent subpixel intensity values are modified according to the second table, thereby reducing the number of subpixels with mid-tone luminance values. The subpixel data is preferably processed within a portion of an application-specific integrated circuit (ASIC), contained within the display module.

28 Claims, 34 Drawing Sheets

OTHER PUBLICATIONS

Active–Matrix LCDs Using Gray–Scale in Halftone Methods: K.R. Sarma, H. Franklin, M. Johnson, K. Frost, A. Bernot: Phoenix Tech. Center, Honeywell, Inc., Phoenix, AZ; SID 89 Digest; pp 148–150.

Halftoning Techniques using Error Correction: G.S. Fawcett and G.F. Schrack; University of British Columbia, Vancouver, BC: Proceedings of the SID, vol. 27/4, 1986.

A Wide–Viewing–Angle 5–in.–Diagonal AMLCD Using Halftone Grayscale; K. Sarma, R. McCartney, B. Heinze; Honeywell, Inc.; Phoenix, AZ, Shingeo Aoki, Yasuhiro Ugai, Tomihisa sunata, Toshiya Inada Hosiden Corp., Osaka, Japan; SID 91 Digest.

IBM Technical Disclosure Bulletin, vol. 33,No. 1A, Jun. 1990, JA888–0261 HS Y. Kaida and M. Yamamoto; Thin film Transistor for Gray Scale LCD; 90A061753.

Electronics and Communications in Japan, Part 2, vol. 80, No. 5, 1997; Development of Wide–Viewing–Angle TFT–LCDs Using Halftone Gray–Scale Method; Y. Ugai, T. Inada, T. Nakagawa and S. Aoki. Research & Development Ctr, Hosiden Corp. Kobe, Japan 651–22 ; pp 89–98.

A Wide–Viewing–Angle 10–Inch–Diagonal Full–Color Active–Matrix LCD Using a Halftone–Grayscale Method; T. Sunata, T. Inada, T. Nakagawa, Y. Matsushita, Y. Ugai, S. Aoki. Hosiden Corp.3–1, Takatsukadai, 4–Chome, Nish-i–ku, Kobe–City, Hyogo, 651–22, Japan ;IEEE 1991.

A Wide–Viewing–Angle Gray–Scale TFR–LCD Using Additive Gray–Level Mixture Driving; S. Ogura, A Nishiki, T. Nomoto, I. Abiko, K. Kaminishi; Oki Electric Industry Co., Ltd.,Tokyo, Japan. SID 92 Digest; pp 593–596.

* cited by examiner

ROW INVERSION

| R | G | B | R | G | B | R | G | B |
|---|---|---|---|---|---|---|---|---|
| + | + | + | + | + | + | + | + | + |
| − | − | − | − | − | − | − | − | − |
| + | + | + | + | + | + | + | + | + |
| − | − | − | − | − | − | − | − | − |

ODD FRAME

| R | G | B | R | G | B | R | G | B |
|---|---|---|---|---|---|---|---|---|
| − | − | − | − | − | − | − | − | − |
| + | + | + | + | + | + | + | + | + |
| − | − | − | − | − | − | − | − | − |
| + | + | + | + | + | + | + | + | + |

EVEN FRAME

FIG.13

DOT INVERSION

| R | G | B | R | G | B | R | G | B |
|---|---|---|---|---|---|---|---|---|
| + | − | + | − | + | − | + | − | + |
| − | + | − | + | − | + | − | + | − |
| + | − | + | − | + | − | + | − | + |
| − | + | − | + | − | + | − | + | − |

ODD FRAME

| R | G | B | R | G | B | R | G | B |
|---|---|---|---|---|---|---|---|---|
| − | + | − | + | − | + | − | + | − |
| + | − | + | − | + | − | + | − | + |
| − | + | − | + | − | + | − | + | − |
| + | − | + | − | + | − | + | − | + |

EVEN FRAME

FIG.14

2 x 2 FULL PIXEL 2 x 4 FULL PIXEL 4 x 2 FULL PIXEL 4 x 2 DOUBLE SUBPIXEL 2 x 2 SUBPIXEL PATTERN
(GREEN/MAGENTA)

14 x 14 PATTERN (BRIGHT)

| | | | | | | | | | | | | | | | | | | | | |
|---|---|---|---|---|---|---|---|---|---|---|---|---|---|---|---|---|---|---|---|---|
| + | − | + | − | + | − | + | − | + | − | + | − | + | − | + | − | + | − | + | − | + |
| − | + | − | + | − | + | − | + | − | + | − | + | − | + | − | + | − | + | − | + | − |
| + | − | + | − | + | − | + | − | + | − | + | − | + | − | + | − | + | − | + | − | + |
| − | + | − | + | − | + | − | + | + | − | − | + | − | + | − | + | − | + | − | + | − |
| + | − | + | − | + | − | + | − | + | − | + | − | + | − | + | − | + | − | + | − | + |
| − | + | − | + | − | + | − | + | − | + | − | + | − | + | − | + | − | + | − | + | − |
| + | − | + | − | + | − | + | − | + | − | + | − | + | − | + | − | + | − | + | − | + |
| R | G | B | R | G | B | R | G | B | R | G | B | R | G | B | R | G | B | R | G | B |

57.1% BRIGHT 42.9% DARK

FIG.20

14 x 14 PATTERN (DARK)

| | | | | | | | | | | | | | | | | | | | | |
|---|---|---|---|---|---|---|---|---|---|---|---|---|---|---|---|---|---|---|---|---|
| + | − | + | − | + | − | + | − | + | − | + | − | + | − | + | − | + | − | + | − | + |
| − | + | − | + | − | + | − | + | − | + | − | + | − | + | − | + | − | + | − | + | − |
| + | − | + | − | + | − | + | − | + | − | + | − | + | − | + | − | + | − | + | − | + |
| − | + | − | + | − | + | − | + | − | + | − | + | − | + | − | + | − | + | − | + | − |
| + | − | + | − | + | − | + | − | + | − | + | − | + | − | + | − | + | − | + | − | + |
| − | + | − | + | − | + | − | + | − | + | − | + | − | + | − | + | − | + | − | + | − |
| + | − | + | − | + | − | + | − | + | − | + | − | + | − | + | − | + | − | + | − | + |
| R | G | B | R | G | B | R | G | B | R | G | B | R | G | B | R | G | B | R | G | B |

57.1% BRIGHT 42.9% DARK

FIG.21

QUAD 25% 2 x 2 SUBPIXEL PATTERN
(GREEN/MAGENTA)

QUAD 75% 2 x 2 SUBPIXEL PATTERN (GREEN/MAGENTA)

QUAD 25% 4 x 2 DOUBLE SUBPIXEL PATTERN

QUAD 75% 4 x 2 DOUBLE SUBPIXEL PATTERN

METHOD AND APPARATUS FOR ADJUSTING SUBPIXEL INTENSITY VALUES BASED UPON LUMINANCE CHARACTERISTICS OF THE SUBPIXELS FOR IMPROVED VIEWING ANGLE CHARACTERISTICS OF LIQUID CRYSTAL DISPLAYS

BACKGROUND OF THE INVENTION

1. Field of the Invention

The invention relates to liquid crystal displays (LCDs) and, more particularly, to improving the viewing angle characteristics of liquid crystal displays.

2. Description of the Related Art

Most modern liquid crystal display panels suffer from poor viewing angle characteristics (color shift and level reversal, as a function of viewing angle) over a range of subpixel intensity values between the bright and dark states. Of the various liquid crystal modes used in these displays, the most commonly used is the Twisted Nematic mode (TN mode), which has poorer viewing angle characteristics than other modes. Typically, a normally white mode is used, so that the fully bright state corresponds to a low applied voltage and the fully dark state corresponds to a high applied voltage. The display picture elements are commonly referred to as pixels, where each pixel usually consists of a group of three subpixels, namely red, green, and blue subpixels. Typical LCDs have a stripe pixel geometry, where the pixels are square in shape, and where all subpixels are shaped as vertical stripes with the height of a full pixel and width of one third of a full pixel. For the normally white mode, using 8-bit drive per color, the highest applied voltage corresponds to an intensity value of zero, and the lowest applied voltage corresponds to an intensity value of 255. Intensity values are also referred to as digital pixel levels, or digital to analog conversion values (DAC values).

The poor viewing angle characteristics result from the variation in optical transmission at different angles as voltage is applied across the liquid crystal cell gap. At a viewing angle of normal incidence to the surface of the display, the luminance increases with digital pixel level, roughly following a power law, generally referred to as a gamma curve. FIG. 1 is an idealized gamma curve illustrating the relationship between luminance and digital pixel level at normal incidence. At viewing angles away from normal incidence, the gamma curve becomes distorted. For a given digital pixel level, the luminance varies strongly with viewing angle. FIG. 2 shows the general trend of relative luminance variation over all viewing angles as a function of the digital pixel level. The variation in luminance has a non-monotonic dependence on pixel level, with the largest variation occurring over a range of pixel levels somewhere between the dark state and bright state.

U.S. Pat. No. 5,847,688 to Ohi et al. describes a technique that provides a new set of analog reference voltages to the data drivers every other frame. This requires additional, specialized circuitry to be added to the drive electronics for the panel. To work well, the method requires reference voltages for different gamma curves to be switched every two or more frames. This is necessary to provide both positive and negative voltages sequentially to the pixel. If the frame rate is 60 Hz, the switching rate of the gamma curve would be 30 Hz or less. If the modulation in luminance between the two gamma curves is large enough, as required to improve the viewing angle characteristics, then flicker will occur. Human visual sensitivity to flicker peaks at about 10 Hz, and the sensitivity at 30 Hz is quite large. Alternatively, if the liquid crystal response speed is not fast enough to fully respond within two frame times, then the liquid crystal director will maintain an average position within the cell structure, and the luminance will not vary with time. The resulting luminance value will be the average of the two gamma curves, and no improvement in viewing angle characteristics will occur.

U.S. Pat. No. 5,489,917 to Ikezaki et al. describes a technique whereby the reference voltage set is altered from the usual condition in that the lowest reference voltages are increased to suppress level reversal. For TN-mode LCDs with the usual rubbing and polarizer configuration, this method improves the viewing angle characteristics in the upward direction (downward-looking) only. The level reversal condition is much stronger in the downward direction (upward-looking), so this method does not address the most noticeable deficiency in the vertical viewing angle characteristics. The method requires that the total range of reference voltages be decreased, which significantly reduces the dynamic range and contrast ratio of the panel.

G. S. Fawcett and G. F. Schrack in "Halftoning Techniques Using Error Correction," Proceedings of the SID, Vol. 27/4, pp. 305-8 (1986), describes general algorithms for producing halftone images on any device, display, or printer which has limited grayscale capability. U.S. Pat. No. 5,254,982 to Feigenblatt et al. describes a halftone method with time-varying phase shift which was intended for LCDs with relatively few intensity grayscale values. The goal of both Fawcett et al. and Feigenblatt et al. is to produce nearly continuous-tone images with devices which have limited grayscale capability. The present invention is intended for use with LCDs with full grayscale capability, and takes full advantage of this capability. Finally, the techniques of Fawcett et al. and Feigenblatt et al. do not provide a method to improve the viewing angle characteristics with the halftone process.

In work done by both Honeywell and Hosiden Corporation, a split pixel structure has been used to increase the acceptable viewing angle range of TN-mode TFTLCDs. This work was described by Sarma et al. in "Active-Matrix LCDs Using Gray-Scale in Halftone Methods," SID Digest, pp. 148–150 (1989); Sarma et al. in "A Wide-Viewing-Angle 5-in.-Diagonal AMLCD Using Halftone Grayscale," SID Digest, pp. 555–557 (1991); Sunata et al. in "A Wide-Viewing-Angle 10-Inch-Diagonal Full-Color Active Matrix LCD Using a Halftone-Grayscale Method," Int. Display Res. Conf. Record, pp. 255–257 (1991); Ugai et al. in "Deployment of Wide-Viewing-Angle TFT-LCDs Using Halftone Gray-Scale Method," Electronics and Communications in Japan, Pt. 2, Vol. 80, No. 5, pp. 89–98 (1997). A summary of this work is also given in U.S. Pat. No. 5,847,688 to Ohi et al. In this technique, each subpixel is divided into two smaller split subpixels. An additional storage capacitor is utilized in combination with different load capacitances of the two split subpixels to provide a different pixel voltage to the two split subpixels. In this way, for a given subpixel voltage applied to the combination of two split subpixels, the transmission of the split subpixels is not the same. This technique is described by the authors as a "halftone gray-scale method." The method is halftone in the sense that one split subpixel is brighter than the other. Because the ratio of voltages applied to the split subpixels tracks as the ratio of the capacitances, the ratio of voltages will be approximately the same for all subpixel levels. For a given subpixel voltage, and different smaller-subpixel voltages, the transmission and viewing angle characteristics of the two small subpixels are not the same. By mixing together the light from the two smaller subpixels, the viewing angle characteristics are also mixed and improved as compared to a single subpixel. A major disadvantage of this approach is that a special subpixel structure is required within the array on the glass panel. To date, this technology has been successfully applied in aircraft cabin entertainment displays, containing subpixels as small as 159 by 477 microns. As the pixel area is decreased, the additional storage capacitance and split pixel structure become increasingly difficult to implement. This limits the extent to which this approach can be applied to computer information displays, in which both a large number and large density of pixels is required. For example, a display with 200 pixels per inch requires subpixel dimensions of approximately 42×126 microns.

Ogura, et al., in "A Wide-Viewing-Angle Gray-Scale TFT-LCD Using Additive Gray-Level Mixture Driving," SID Digest, pp. 593–596 (1992), describe a technique for improving the viewing angle characteristics of TFTLCDs by using additive gray-level mixture driving. In that work, pixels in odd columns are supplied with pixel voltages different from pixels in even columns. The voltage difference between columns is held at a constant value, slightly less than the threshold voltage of the liquid crystal material. The technique requires a dual-bank data driver arrangement, in which alternate columns are connected to data driver chips above and below the array. Furthermore, the top and bottom banks of data driver chips must have different sets of reference voltages supplied to them. This approach was applied to a normally-white twisted-nematic o-mode LCD. It was found that the horizontal viewing range was increased by about 10 degrees. This paper contains the understanding that pairs of pixel columns can be combined to improve the viewing angle characteristics. One deficiency of the technique is that a special, on-glass configuration is required, namely a dual-bank configuration. The control electronics must also be modified to provide an extra set of reference voltages. Another problem is that a constant offset between column pixel voltages will not result in a luminance which for all levels matches the case where both columns have the same pixel voltage. This is a consequence of S-shaped transmission-voltage characteristics which are typical of all twisted nematic mode LCDs. Having a constant offset voltage which is independent of the input pixel data also causes problems with fine image patterns. A checkerboard or alternating-column kind of image pattern will not be properly rendered. For certain patterns in which pixel data correspond to the offset voltage, the pattern could either be twice as intense or may disappear altogether.

Other techniques to improve the viewing angle characteristics of liquid crystal displays involve altered or special pixel structures, liquid crystal modes, or wiring within the panel array. Examples of other techniques include dual-domain TN-mode, multidomain vertical alignment (MVA) and in-plane switching (IPS). These techniques which require special structures within the glass panel are inherently more expensive to develop and manufacture than techniques which avoid special structures. The IPS mode generally requires more power in operation than the other modes. As such, these techniques have more general applicability to desktop monitors than to notebook computer displays. Furthermore, many of these approaches are generally not extendible to high density pixel arrays because special pixel structures require that a large fraction of the total available area be devoted to the purpose of viewing angle improvement. The remaining fraction limits the aperture area which can be achieved in a design as the pixel area is decreased. Complicated pixel structures are also difficult to manufacture with high yield.

Thus, there remains a need in the art to provide an efficient and low cost mechanism that improves the viewing angle characteristics of modern liquid crystal display panels, especially for notebook computer displays.

SUMMARY OF THE INVENTION

The method and apparatus of the present invention provide a very low-cost way to improve the viewing angle characteristics of liquid crystal displays. The present invention provides an efficient mechanism to modify the intensity values (in digital form) of the subpixels of the display using dithering techniques that take into consideration the non-ideal luminance characteristics of the subpixels of the panel, thereby improving the displayed image by suppressing or eliminating level reversal and color shift over a wide range of viewing angles.

According to the present invention, the data which is supplied to the panel is altered; therefore, it is not necessary to alter or change the liquid crystal cell, pixel structure, or glass panel, which are expensive and difficult to implement. The present invention can be implemented within the display subsystem, the data processing portion of the controller electronics within the display module, or operating system or application software. As the pixel density increases, the image quality and overall performance of this technique improves. Unlike other techniques which involve changes in physical pixel structure, this invention is easy to implement as the pixel density increases. This technique does not require special structures within the glass panel, and is intended for use with LCD's with full grayscale capability, and takes full advantage of that capability, as well as the full dynamic range of the panel. In addition, image data containing text, line art, or other information can be preserved, as described in more detail below. Because only the data is altered, the method or apparatus can be controlled by the user, with the option of turning it off completely or altering the degree to which the viewing angle characteristics are changed. In this invention, both the luminance and color changes with viewing angle are reduced.

The present invention not only improves viewing angle characteristics, it can also be used to improve color management and control by restricting the subpixel colors to a range having well-behaved states, without reduction in the number of renderable colors.

This technique could be applied to any liquid crystal display which has viewing angle variations. Examples include thin-film-transistor liquid-crystal displays (TFTLCDs), otherwise known as active-matrix liquid-crystal displays (AMLCDs). The active thin film transistor devices which address the pixels in the array could be made of any material, such as amorphous silicon (a-Si), polycrystalline silicon (poly-Si), single-crystal silicon, or organic materials. The invention is also applicable to other kinds of liquid crystal display devices, such as passive-matrix LCDs, otherwise known as super-twisted nematic liquid crystal displays (STNLCDs), and ferroelectric LCDs.

In the method of generating an improved image according to the present invention, intensity values associated with the data elements of an image are modified to reduce the number of mid-tone intensity values between the bright and dark intensity values. Intensity values are modified according to the dependence of subpixel luminance on intensity and at least one viewing angle of the liquid crystal display. Intensity values are also modified according to other defined conditions on the data elements of the image. For example, if the data elements of a portion the image meet certain criteria, there is no modification of the intensity values.

In a preferred embodiment, a first plurality of entries providing an association between intensity value and luminance value for subpixels of an LCD display in at least one viewing angle direction are provided. In addition, a second plurality of entries providing an association between a target intensity value and intensity values outside the mid-tone intensity range are provided. The intensity values are modified to reduce the number of mid-tone values by: generating a first luminance value from subpixel intensity values using the first plurality of entries for image data, identifying a target intensity corresponding to that luminance by using the first plurality of entries, and identifying intensities outside the mid-tone range by using the second plurality of entries.

The preferred apparatus according to the present invention is a pixel data processor within the electronics of the display controller, implemented as part of an application-specific integrated circuit (ASIC) contained within the display panel module. The pixel data processor modifies intensity values associated with the data elements of an image to reduce the number of mid-tone intensity values between the bright and dark intensity values. Intensity values are modified according to the dependence of subpixel luminance on intensity and at least one viewing angle or range of viewing angles of the liquid crystal display.

The above and other features and advantages of the present invention will be apparent from the following description of preferred embodiments of the invention with reference to the accompanying drawings.

BRIEF DESCRIPTION OF THE DRAWING

FIG. 13 is an illustration of pixel polarities used in row inversion.

FIG. 14 is an illustration of pixel polarities used in dot inversion.

FIG. 20 is an illustration of a 14×14 staggered subpixel pattern, with a majority of bright subpixels.

FIG. 21 is an illustration of a 14×14 staggered subpixel pattern, with a majority of dark subpixels.

DESCRIPTION OF THE PREFERRED EMBODIMENTS

Figure 3:
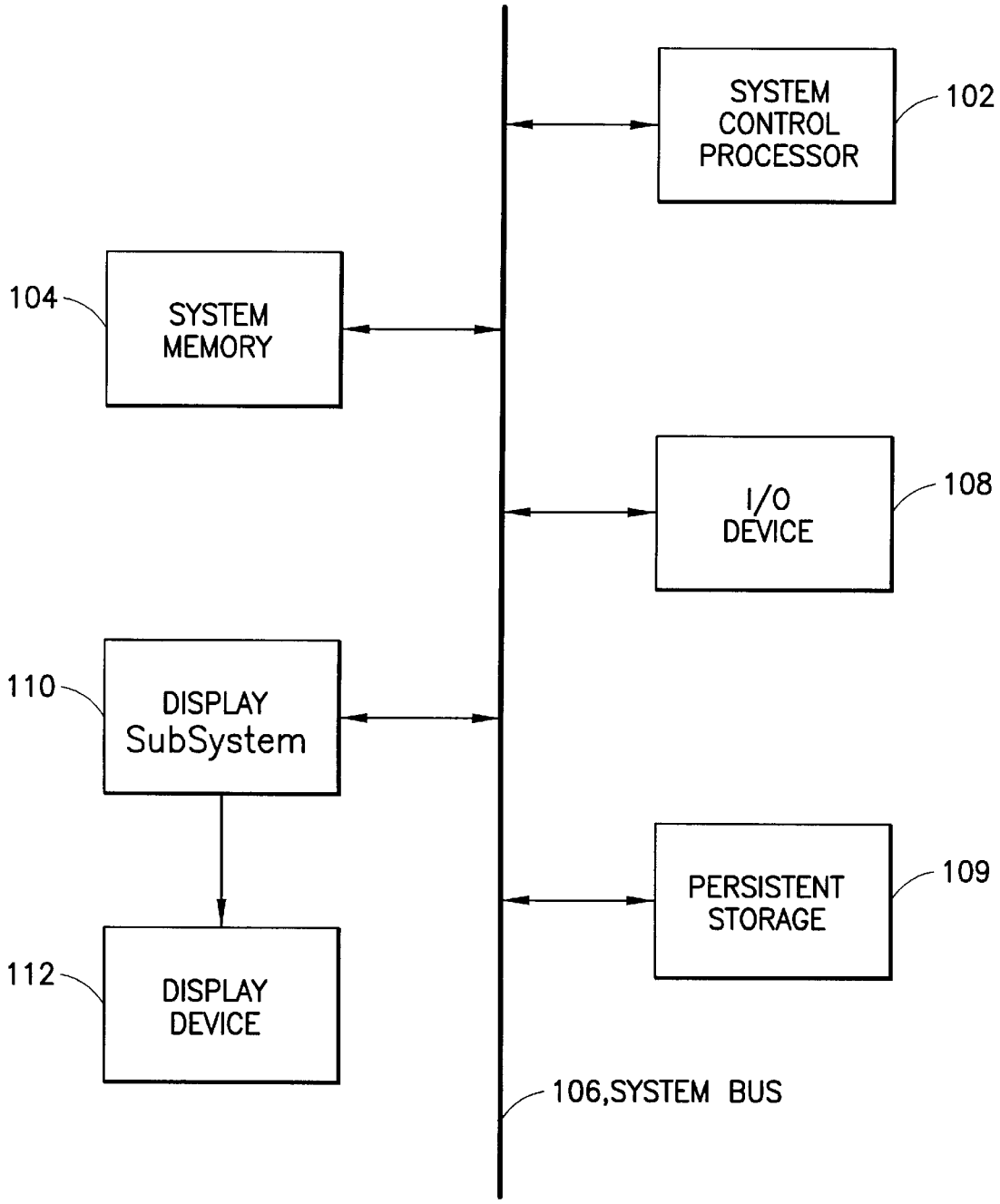
FIG. 3 is functional block diagram of a computer system in which the present invention may be embodied.

The overall architecture of an exemplary system that embodies the present invention is depicted in FIG. 3. As shown, a computer system 100 includes a processor 102 which is operatively coupled to system memory 104 and other components via a system bus 106. The system memory 104 includes random access memory that stores the operating system of the computer system 100 and application software, if needed. For the sake of description, the system bus 106 is shown as a single bus; however, it is readily apparent to one skilled in the art that the system bus may comprise one or more buses (which may utilize different bus protocols) depending upon the architecture and design of the computer system 100. For example, the system bus 106 may include a plurality of buses organized in a hierarchical manner as is typical in modern Intel-based architected systems. The operating system and application software are typically loaded into the system memory 104 from persistent storage 109, such as a fixed disk drive or other nonvolatile memory. In addition, the operating system and application software may be loaded into system memory 104 from network resources via a communication adapter (not shown)

such as a modem, a local area network adapter network, a wide area network adapter or other communication device. Input/output (I/O) devices 108 operatively couple to processor 102 via the system bus 106. The I/O devices 108 may include a keyboard, template or touch pad for text entry, a pointing device such as a mouse, trackball, or light pen for user input, and speech recognition for speech input.

The operating system controls the allocation and usage of the hardware resources of the computer system 100, and is the foundation on which the application software is built. The application software works in conjunction with the operating system and user input to perform specific tasks. Examples of application software include a word processor, spreadsheet program, web-browser, video player, 3-D modeling and navigation software, 3-D game software, etc.

The computer system 100 includes a display subsystem 110 that interfaces to the processor 102 and the system memory 104 via the system bus 106. Generally, the display subsystem 110 operates to generate images for display on the display device 112 based upon commands generated by the processor 102 and transferred to the display subsystem 110 via the system bus 106.

The operating system includes an implementation of a programming interface (hereinafter "graphics programming interface") that is used by other parts of the operating system and application software to transfer commands and data to the display subsystem 110 in order to generate images for display on the display device. More specifically, the operating system and/or application software works in conjunction with the graphics programming interface to load data (such as text data, bit-map pixel data, and three-dimensional graphics data) into system memory 104 in a form suitable for use by the display subsystem 110. In addition, the operating system and/or application software works in conjunction with the graphics programming interface to generate commands associated with the data in a form suitable for use by the display subsystem 110, and transfers the commands to the display subsystem 110 via the system bus 106. The display subsystem 110 performs the operations dictated by the commands to generate image data for display on the display device. The commands transferred to the display system may be, for example, a command to draw a line, a command to draw a window, a command to render a bit-map image, a command to render a three dimensional image, a command to decode a video stream, etc. The display device 112 may utilize raster scan techniques (such as a CRT display device) or array switching techniques (such as liquid crystal/TFT display device) to display the pixels.

The display subsystem 110 of the present invention as described below may be implemented in hardware as, for example, a gate array or a chip set that includes at least one programmable sequencer, memory, integer processing unit (s) and floating point unit(s), if needed. In addition, the display subsystem 110 may include a parallel and/or pipelined architecture. In the alternative, the display subsystem 110 may be implemented in software together with a processor. The processor may be a conventional general purpose processor, a part of the host processor 102, or part of a coprocessor integrated with the host processor 102.

Figure 4:
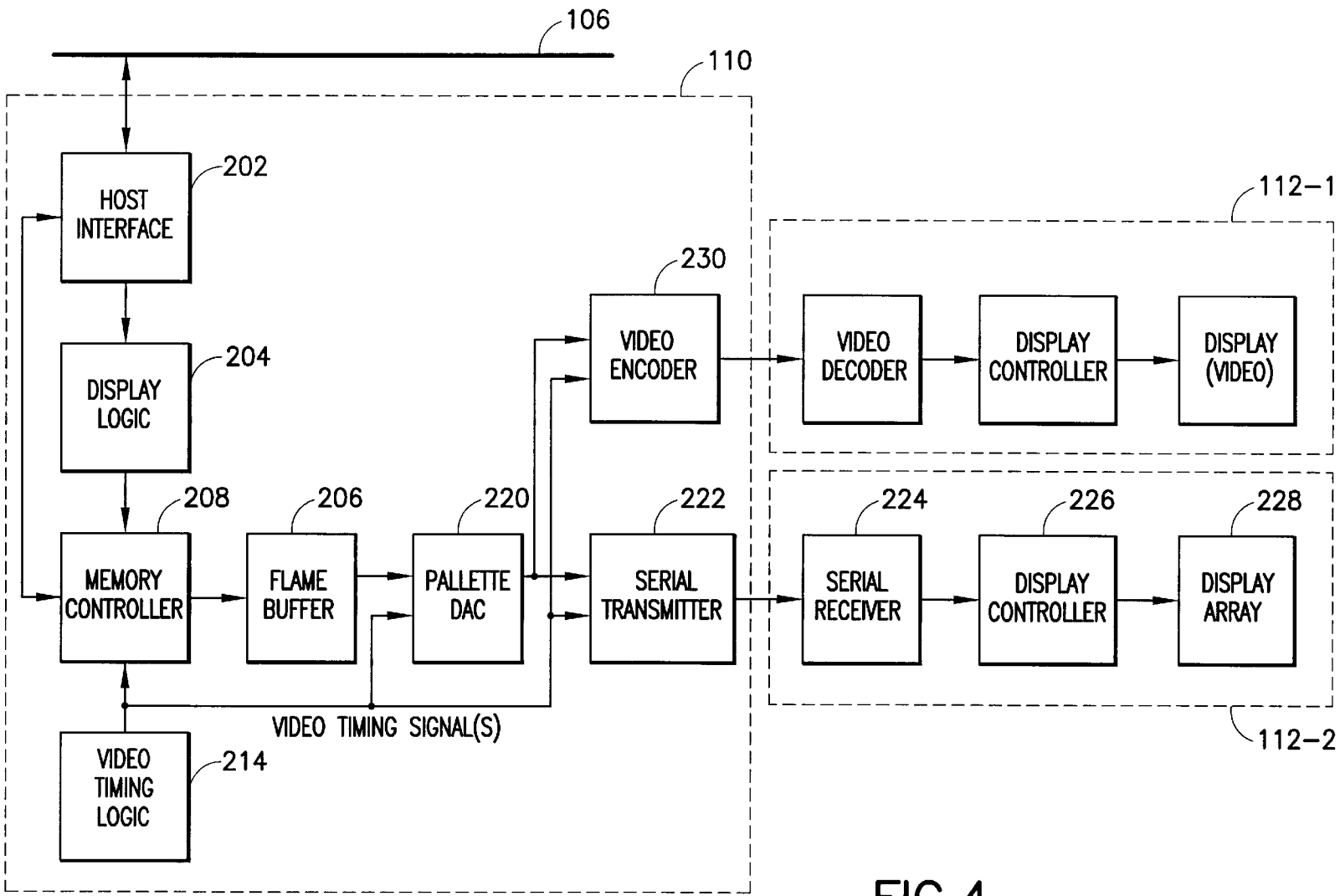
FIG. 4 is a functional block diagram of the display subsystem of FIG. 3.

An example of the display subsystem 110 is shown in FIG. 4. More specifically, the exemplary display subsystem 110 includes a control processor 200 (not shown) that supervises the operations performed by the other elements of the display subsystem 110. The display subsystem 110 attaches to the system bus 106 via a host interface 202, which reads and writes data from and to the system bus 106 by performing the communication protocol of the system bus 106.

The display subsystem 110 includes display logic 204 that performs the operations dictated by the commands received via the system bus 106 to generate image data for display on the display device 112. The display logic 204 may include a microprocessor or may include special purpose hardware for performing a specific class of operations.

The image data generated by the display logic 204 is stored in a frame buffer 206 under control of a memory controller 208. In addition, the contents of the frame buffer 206 can be read back and transferred to the system control processor 102 via the memory controller 208 and host interface 202.

The frame buffer 206 typically contains sufficient memory to store color data (in digital form) for each pixel of the display device 112. Conventionally, the color data consists of three sets of bits (for example, 38-bit integers) representing red, green and blue (r,g,b) colors for each pixel. Conventionally, the frame buffer 206 is arranged in a matrix of rows and columns each n bits deep wherein the particular row and column address corresponds to the pixel location on the display device 112. In addition, the display subsystem 110 may include two frame buffers. In the conventional system, one of the frame buffers serves as the active display portion, while the other frame buffer is updated for subsequent display. Either frame buffer may change from being active to inactive in accordance with the needs of the system 100; the particular manner in which the changeover is accomplished is not relevant to the present invention.

The display subsystem 110 also includes video timing logic 214 that generates video timing signals that control the transfer of pixel data from the frame buffer 206 to the display device 112. More specifically, the video timing logic 214 generates a pixel clock signal, a horizontal synchronization signal (or HSYNCH signal) and a vertical synchronization signal (VSYNCH). The pixel clock signal represents the transition between pixels in a given line of the display. The HSYNCH signal represents the transition from one line to another line of the display device, and the VSYNCH signal represents the transition from one frame (i.e., the last line of a frame) to the next frame (i.e., the first line of the next frame) of the display device.

The video timing signals are provided to memory controller 208, which generates an address signal based upon such video timing signals supplied thereto. The address signals generated by the memory controller 208 are provided to the frame buffer 206 to cycle through the pixel locations of the frame buffer 206. In each address cycle, the pixel data for one or more pixels is read from the frame buffer 206 and transferred to a palette DAC 220.

The palette DAC 220 maps the pixel data output from the frame buffer 206 to a color space (which, for example, may be a 24 bit integer value) used on the display. Preferably, the palette DAC 200 utilizes a table look-up that operates synchronously with the pixel clock signal generated by the video timing logic 214.

In computer systems (e.g., desktop computer systems), the palette DAC 220 forwards the transformed pixel data to a video encoder 230 that encodes the transformed pixel data into a video signal, such as an NTSC signal, MPEG video signal or HDTV signal, for output to a video device 112-1, such as a CRT monitor. The video device 112-1 includes a decoder, display controller and a display that decodes the video signal and displays the image represented by the pixel data encoded therein.

In some computer systems (e.g., notebook computers), the palette DAC 220 forwards the transformed pixel data, typically one pixel at a time, to a serial link transmitter 222. The serial link transmitter 222 receives the pixel data, serializes the pixel data into a bit stream, and transfers the bit stream to a display module 112-2 over a high speed serial channel. The display module 112-2 includes a serial link receiver 224 that receives the bit stream. Preferably, the serial link transmitter 222 and receiver 224 operate synchronously with the pixel clock signal generated by the video timing logic 214. An example of the serial link transmitter 222 and receiver 224 is the DS90CR383/DS90CR284 channel link manufactured by National Semiconductor. In addition, the signals communicated between the serial link transmitter 222 and receiver 224 preferably include a clock signal generated by the serial link transmitter 222 that is derived from the pixel clock signal generated by the video timing logic 214. The serial link receiver 224 utilizes the clock signal communicated between the serial link transmitter 222 and receiver 224 to reconstruct the pixel clock signal. For example, the clock signal communicated between the serial link transmitter 222 and receiver 224 may be the pixel clock signal stepped down by a factor of $2^N$ (where N is an integer greater than or equal to 0).

The serial receiver 224 recovers the pixel data from the serial bit stream, and forwards the pixel data to display controller 226. In addition, the serial link receiver 224 utilizes the clock signal communicated between the serial link transmitter 222 and receiver 224 to reconstruct the pixel clock signal, and forwards the pixel clock signal to the display controller 226. The display controller 226 utilizes the pixel clock signal and pixel data received from the serial link receiver 224 to generate signals supplied to a display array 228 to thereby generate an image for display.

Figure 5:
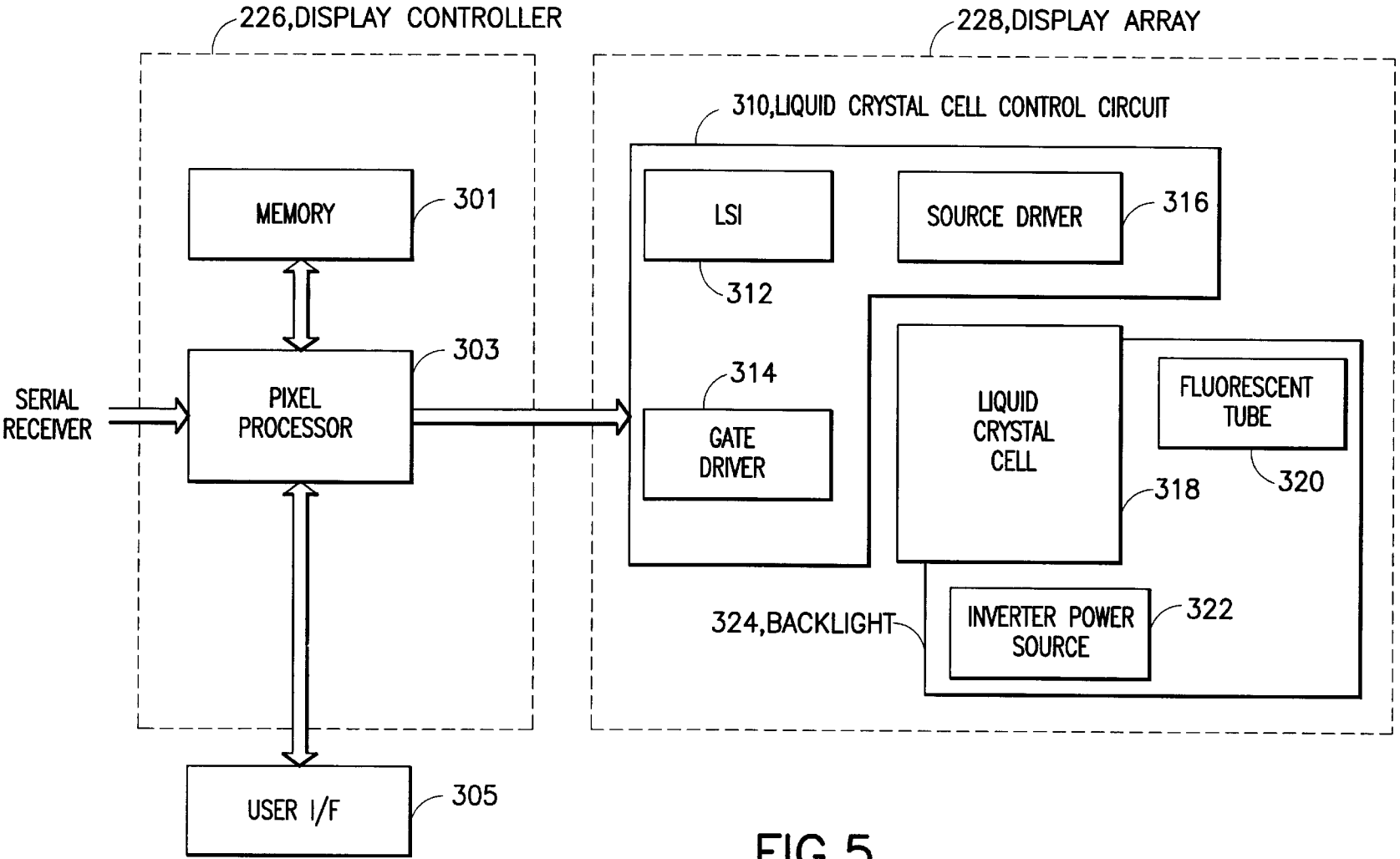
FIG. 5 is a functional block diagram of the Display Controller and Display Array of FIG. 4.

The display controller 226 utilizes a predetermined driving scheme (for example, row inversion, column inversion, or dot inversion) to generate the image for display. FIG. 5 illustrates an exemplary embodiment of the display controller 226 and display array 228 of FIG. 4. More specifically, the display controller 226 includes memory 301 for storing the pixel data forwarded by the serial receiver 224. Pixel processing circuitry 303 (which is typically embodied by a controller or a gate array) transforms the pixel data stored in memory 301 and outputs the transformed pixel data to the display array 228. The display array 228 includes a liquid crystal cell control circuit 310, a liquid crystal cell 318, and a backlight 324. The liquid crystal cell control circuit 310 includes, as panel driver components, an LCD controller LSI 312, a source driver 316 and a gate driver 314. The LCD controller LSI processes the transformed pixel data, including the pixel data clock supplied by receiver 224, which signals are received from the display controller 226, and outputs signals to the source driver 316 and the gate driver 314, including timing control signals generated from the pixel data clock. The source driver 316 generates a gray scale signal (in analog form) corresponding to the supplied pixel data and outputs the gray scale signal (in analog form) on the appropriate data line of the display array. An example of the source driver 316 is the MPT57481 Source Driver manufactured and sold by Texas Instruments. Gate line driver 314 generates addressing signal(s) to activate appropriate subpixels of the display array in order to provide the gray scale signals (in analog form) supplied on the data lines to the appropriate subpixels of the display array. An example of the gate line driver circuitry 309 is the MPT57604 Gate Driver manufactured and sold by Texas Instruments. The backlight 324 illuminates the liquid crystal cell 318 from the back or the side. The backlight 324 includes a fluorescent tube 320 and an inverter power source 322. The display controller 226 may also be provided with a user interface 305, to allow the user to adjust, for example, the degree to which the viewing angle characteristics are changed.

According to the present invention, the data sent to the display array is modified to enhance the viewing angle characteristics of the liquid crystal display. The data modification may be implemented in hardware within the display subsystem or, as is preferred, entirely within the data processing portion of the controller electronics within the display module, or alternatively in operating system or application software. The software may reside on any medium readable by a computer system having a display, e.g. a disk, tape, CD, etc.

The data modification scheme depends on the properties of the liquid crystal display, such as its luminance and viewing angle characteristics. Presently used liquid crystal displays have good viewing angle characteristics in the bright state. The viewing angle characteristics in the dark state may be poor, but because the luminance is relatively small, this does not affect the viewer's perception. For certain levels or ranges of luminance between the dark and bright states, the luminance deviates strongly from an isotropic or Lambertian distribution with viewing angle, and at certain viewing angles the luminance does not monotonically increase with pixel level. This adversely affects the image quality by causing color shift and contrast reversal. By suppressing these problematic mid-tone levels in favor of brighter or darker levels, the present invention achieves the desired luminance level for the viewer, but does so using display elements which have good viewing angle characteristics. The improvements in viewing angle characteristics are achieved concurrent with some loss of image resolution.

The subpixel luminance of a liquid crystal display roughly follows a power-law dependence on digital pixel level, sometimes referred to as the gamma characteristics or gamma curve. Ideally, the subpixel luminance versus input digital subpixel level follows the simple relationship given in Eq. 1 below. $Y_{max}$ and $Y_{min}$ are the maximum and minimum luminances at normal incidence to the display, and n is the pixel digital level, or DAC level. For a display with 8-bit color, each subpixel has 256 levels, and the levels span the range from 0 to 255. A plot of this relationship is given in FIG. 6, for $\gamma$=3.0 and $Y_{max}/Y_{min}$=500.

$$Y=Y_{min}+(Y_{max}-Y_{min})\cdot(n/255)^{\gamma} \quad \text{Eq. (1)}$$

Figure 6:
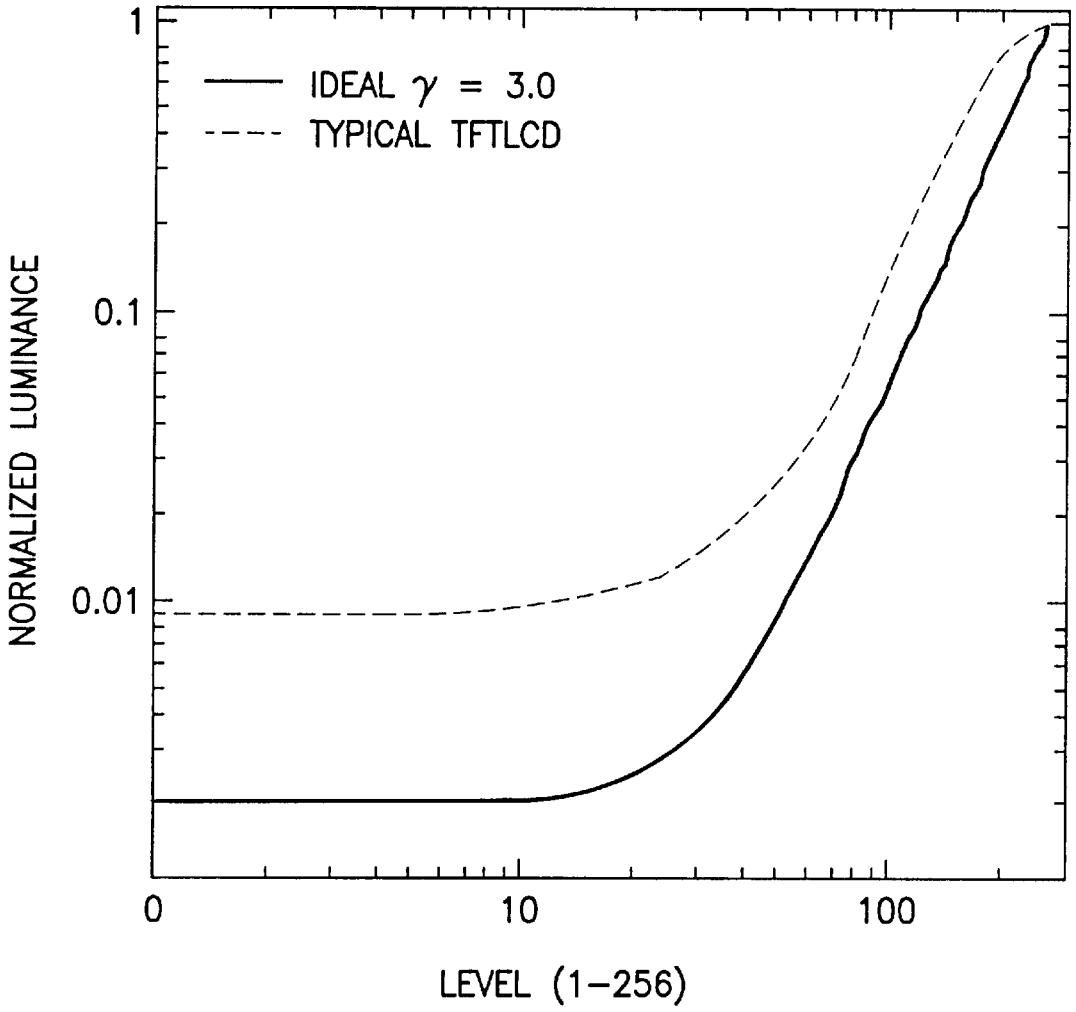
FIG. 6 is a graph of the detailed characteristics of luminance on intensity level.

Many liquid crystal displays do not follow this relationship precisely, but instead exhibit gamma characteristics with an S-shaped curve, in which the maximum luminance occurs at a pixel level somewhat below level 255. An example of an S-shaped gamma curve for a typical liquid crystal display found in notebook computers is also shown in FIG. 6. Typical liquid crystal cells have transmission versus cell voltage characteristics, which are also S-shaped. It is often erroneously assumed that the S-shape of the transmission characteristics leads to an S-shaped gamma curve. The shape of the gamma curve is determined by the particular choice of relationship between pixel levels and drive voltages provided to the liquid crystal panel.

Figure 7:
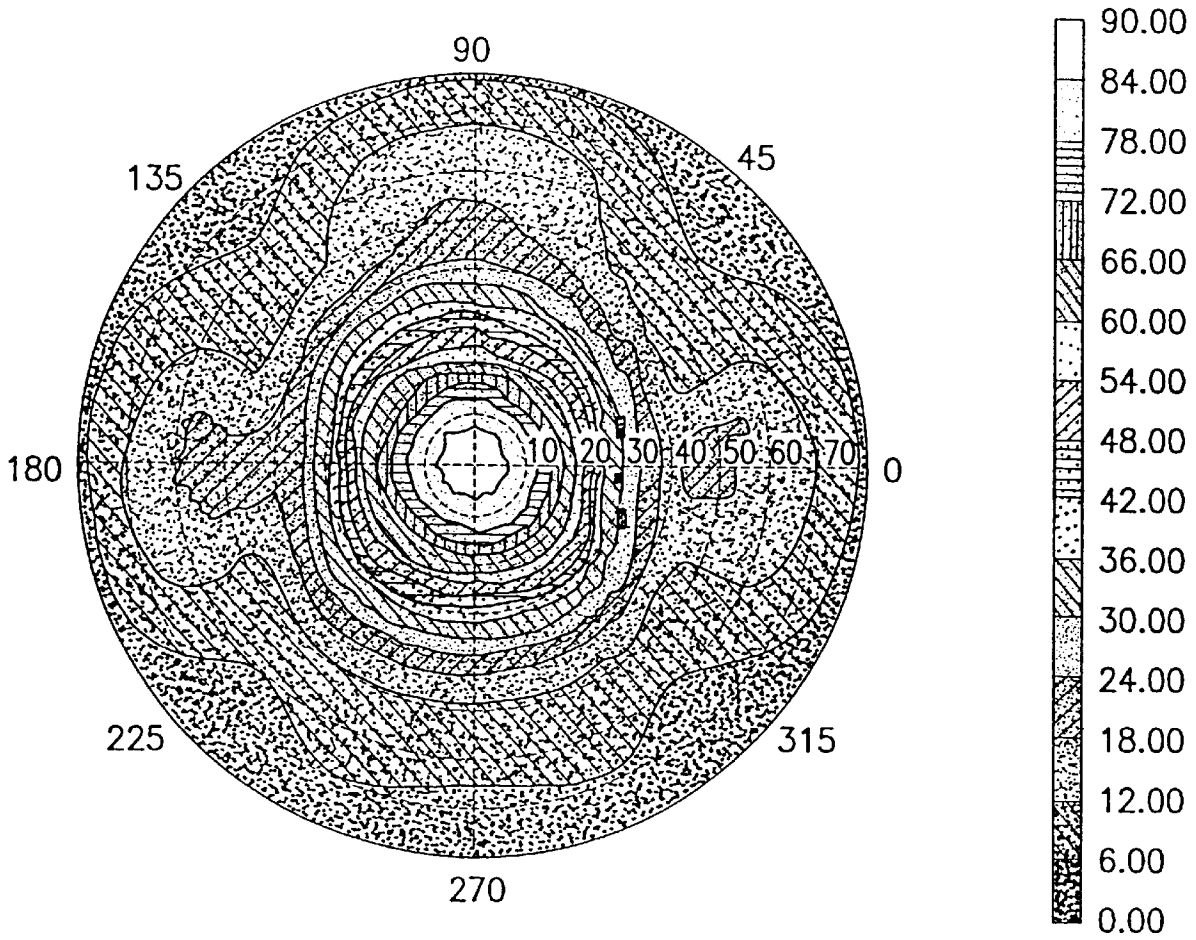
FIG. 7 is a polar plot of luminance of a TN-mode TFTLCD for level 255.
Figure 8:
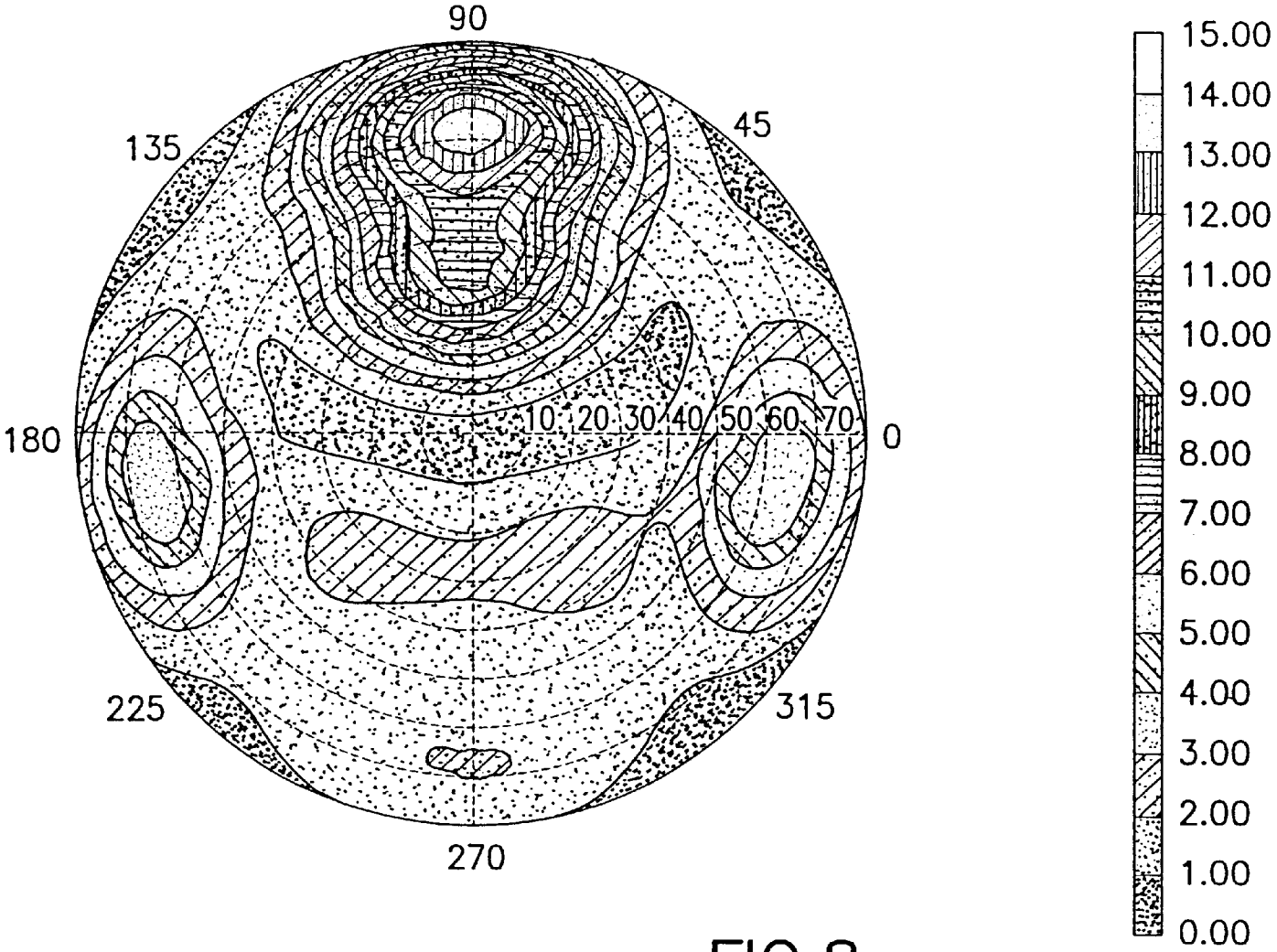
FIG. 8 is a polar plot of luminance of a TN-mode TFTLCD for level 0.

For most liquid crystal modes and pixel cell structures used in TFTLCDs, the luminance does not remain constant with viewing angle. Furthermore, as the pixel level is decreased from the bright state, the variation in luminance with viewing angle over a range of viewing angles becomes larger. Examples of polar plots of luminance versus viewing angle for a twisted-nematic mode TFTLCD are given in FIG. 7 and FIG. 8 for pixel levels 255 and 0, where all subpixels are the same value (R=G=B), i.e. the gray condition. Considering the range of characteristics exhibited over the entire range of pixel levels (0 to 255), at particular viewing angles, the luminance over a range of pixel levels can be excessively bright compared to the gamma curve at normal incidence, or excessively dark compared to the gamma curve. For some liquid crystal configurations, at particular viewing angles, the luminance relationship with pixel level can become reversed, that is, the luminance at lower pixel values can be brighter than the luminance at higher pixel values. This situation is referred to as level reversal, and images viewed at these angles with pixel values in this range exhibit reverse contrast. For twisted-nematic mode liquid crystal displays, all of these effects generally occur. For liquid crystal displays with wide-viewing-angle modes other than twisted-nematic, there are also variations in luminance (and color) with viewing angle, but those generally do not exhibit level reversal.

For twisted-nematic mode liquid crystal displays, the strongest variation in luminance occurs in the vertical direction, as the incident viewing angle is varied from below normal incidence to above normal incidence. An example of the luminance characteristics versus vertical viewing angle for a twisted-nematic mode liquid crystal display is given in FIG. 9, which consists of a family of curves corresponding to vertical cuts in polar plots of luminance at an azimuthal angle of 90 degrees. Positive values of viewing angle (theta) correspond to the upward direction from the panel normal (as viewed downward) and negative values of viewing angle correspond to the downward direction from the panel normal (as viewed upward). It is seen that as the pixel level is reduced from 255 toward 0, the luminance peak moves from a vertical viewing angle theta of zero to positive theta angles. As the incident angle increases above zero, the luminance curves become more closely spaced, and cluster together toward the highest pixel levels. The luminance behavior in this region is excessively bright. As the incident angle decreases below zero, the family of luminance curves retain most of their relative spacing, but the overall magnitude of the curves drops off much more sharply with incident angle than for the case of positive incident angles. The luminance behavior in this region is excessively dark. For the lowest pixel levels, as the viewing angle is made more negative, the luminance curves cross, corresponding to the level reversal condition discussed previously. For the very highest positive incident viewing angles and pixel levels, there can also be some level reversal.

Figure 9:
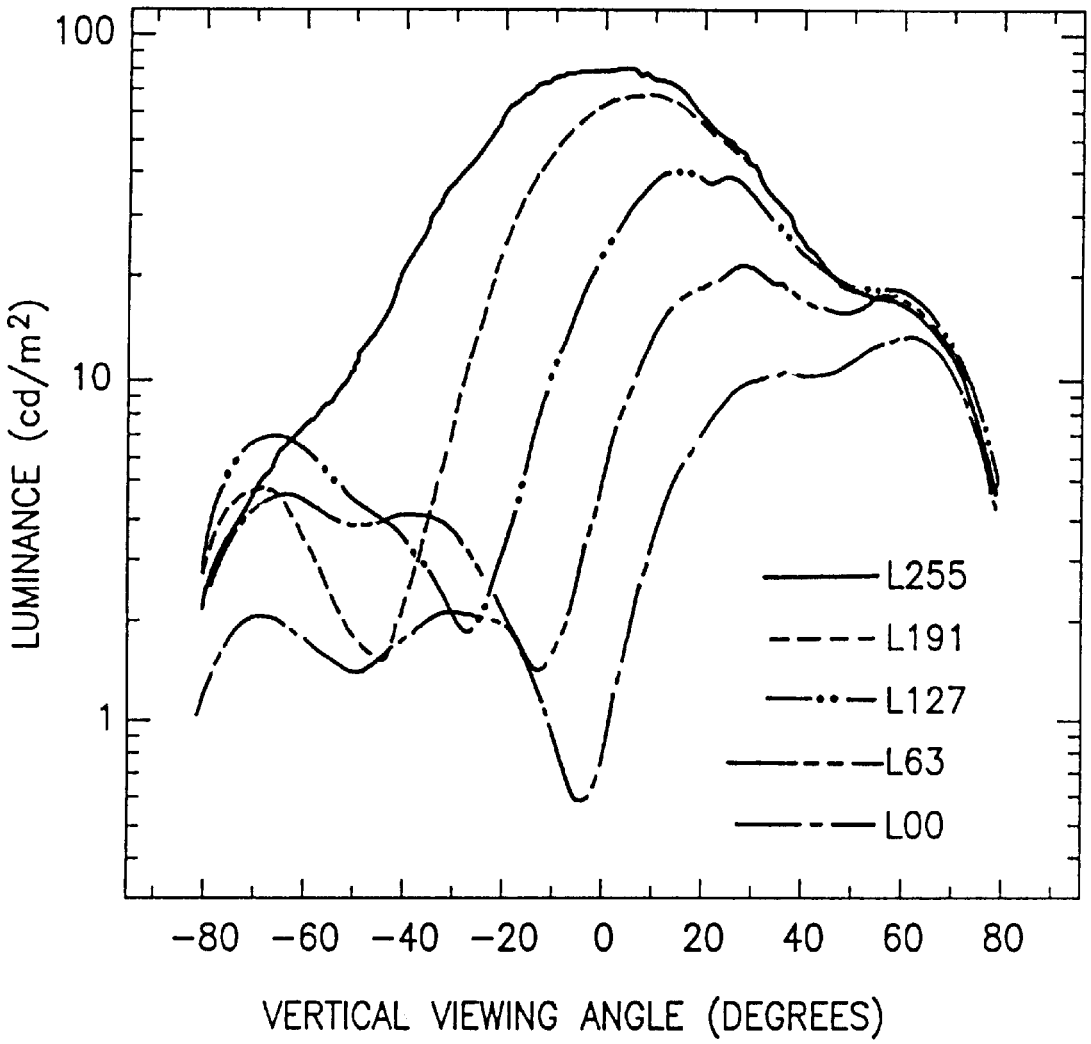
FIG. 9 is a graph showing the luminance of a TN-mode TFTLCD in the vertical plane.
Figure 10:
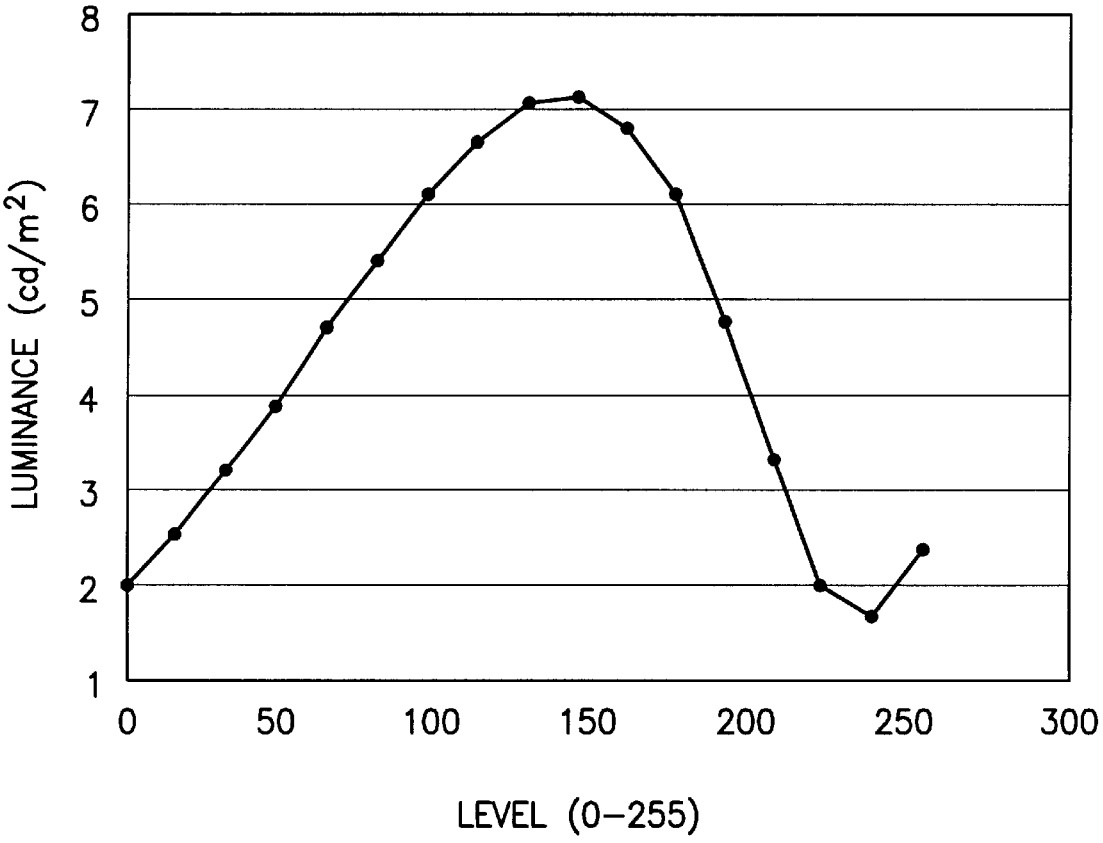
FIG. 10 is a graph of luminance versus digital pixel level from FIG. 9 at a vertical viewing angle of 62 degrees below normal incidence.

In FIG. 10, a plot of luminance versus pixel level at a vertical viewing angle of −62 degrees is shown for the data in FIG. 9. At this viewing angle, the luminance generally exhibits a local maximum, and does not follow a gamma-type relationship. The luminance is not monotonic, and peaks at a mid-tone gray level below the midpoint of the range of levels. This luminance can be viewed as an error function, with a maximum error for midrange pixel levels.

Figure 11:
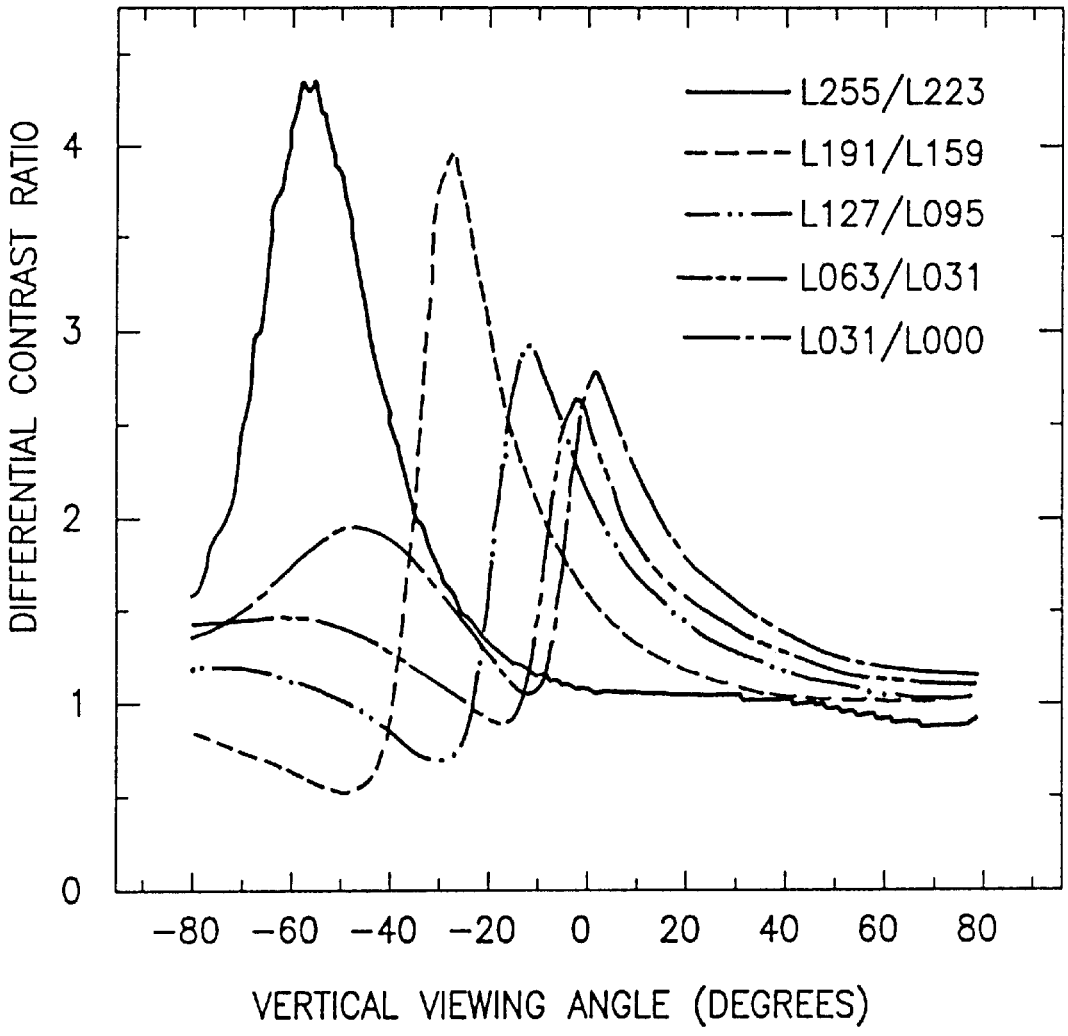
FIG. 11 is a graph of differential contrast ratios versus vertical viewing angle.

To examine the level reversal effect more closely, a plot of a family of differential contrast ratios can be constructed from the data in FIG. 9, as shown in FIG. 11. The differential contrast ratios are the ratio of luminances between selected pixel levels. In FIG. 11, several ratios of levels are shown. Ideally, the differential contrast ratio (CR') for two levels $n_1$ and $n_2$ should follow from the gamma relationship:

$$CR^1 \cong (n_1/n_2)^\gamma \qquad \text{Eq. (2)}$$

In FIG. 11, it is evident that the differential contrast ratios do not follow this relationship. For incident viewing angles in the range 0 to +35 degrees, the differential contrast ratios remain relatively well behaved, reflecting the non-ideal gamma relationship typical of LCDs near normal incidence. For incident viewing angles in the range +35 to +80, the differential contrast ratios of the highest levels drops below 1, indicative of level reversal. For incident viewing angles in the range of 0 to −80 degrees, the differential contrast ratio characteristics very strongly deviate from acceptable behavior. For the lowest pixel levels below level 31, the minimum differential contrast ratio reaches a value close to 1 for a vertical viewing angle of about −10 degrees. As the pixel level is increased, the minimum differential contrast ratio dips strongly below 1, and the location of the minimum ratio moves to larger negative incident viewing angles. The smallest differential contrast ratio occurs between levels 223 and 207 at an incident viewing angle of about −65 degrees. For levels higher than this, the differential contrast becomes larger than 1 for all vertical viewing angles between 0 and −80 degrees. It is clear from this plot, that for negative vertical viewing angles, a broad range of pixel levels between approximately level 31 and level 223 exhibit undesirable level reversal characteristics.

Figure 1:
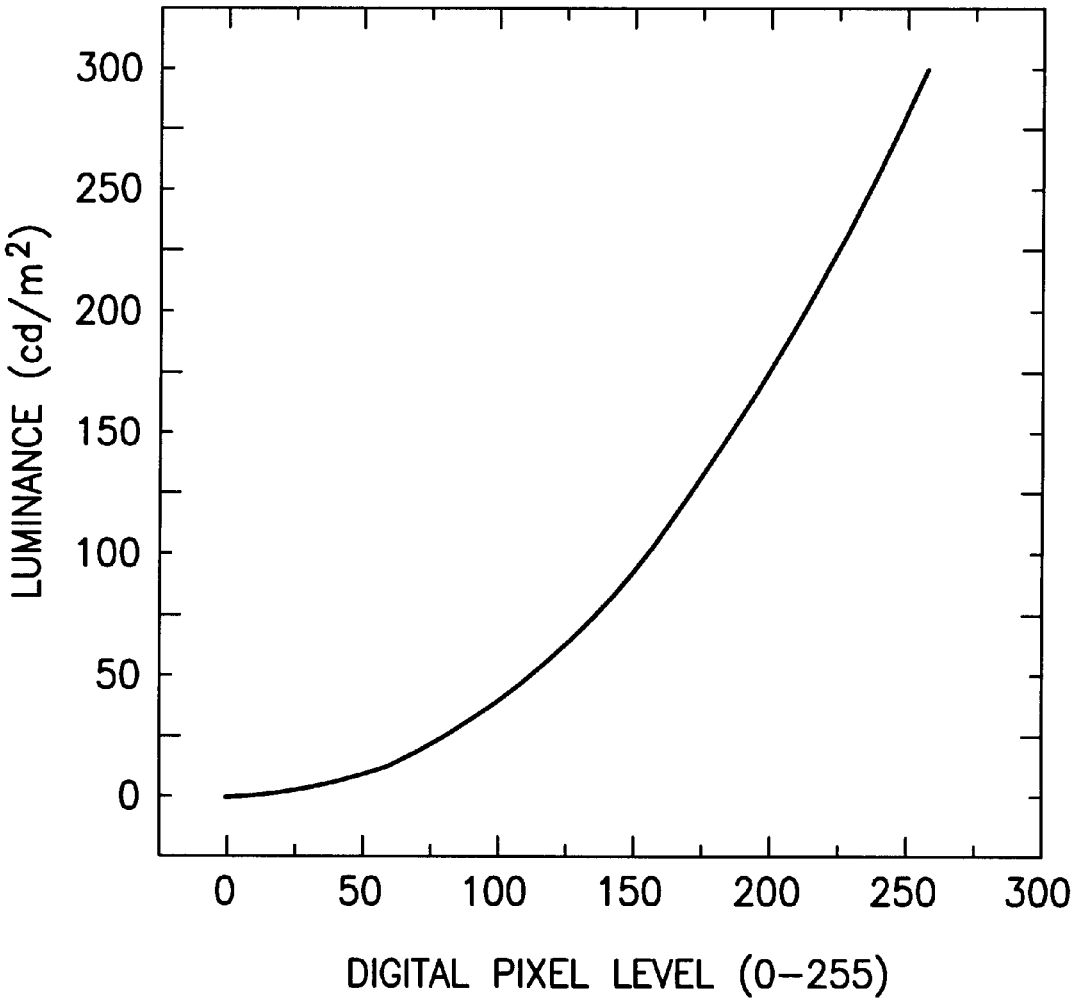
FIG. 1 is a graph illustrating the idealized dependence of luminance on digital pixel level intensity values, at a viewing angle of normal incidence.
Figure 2:
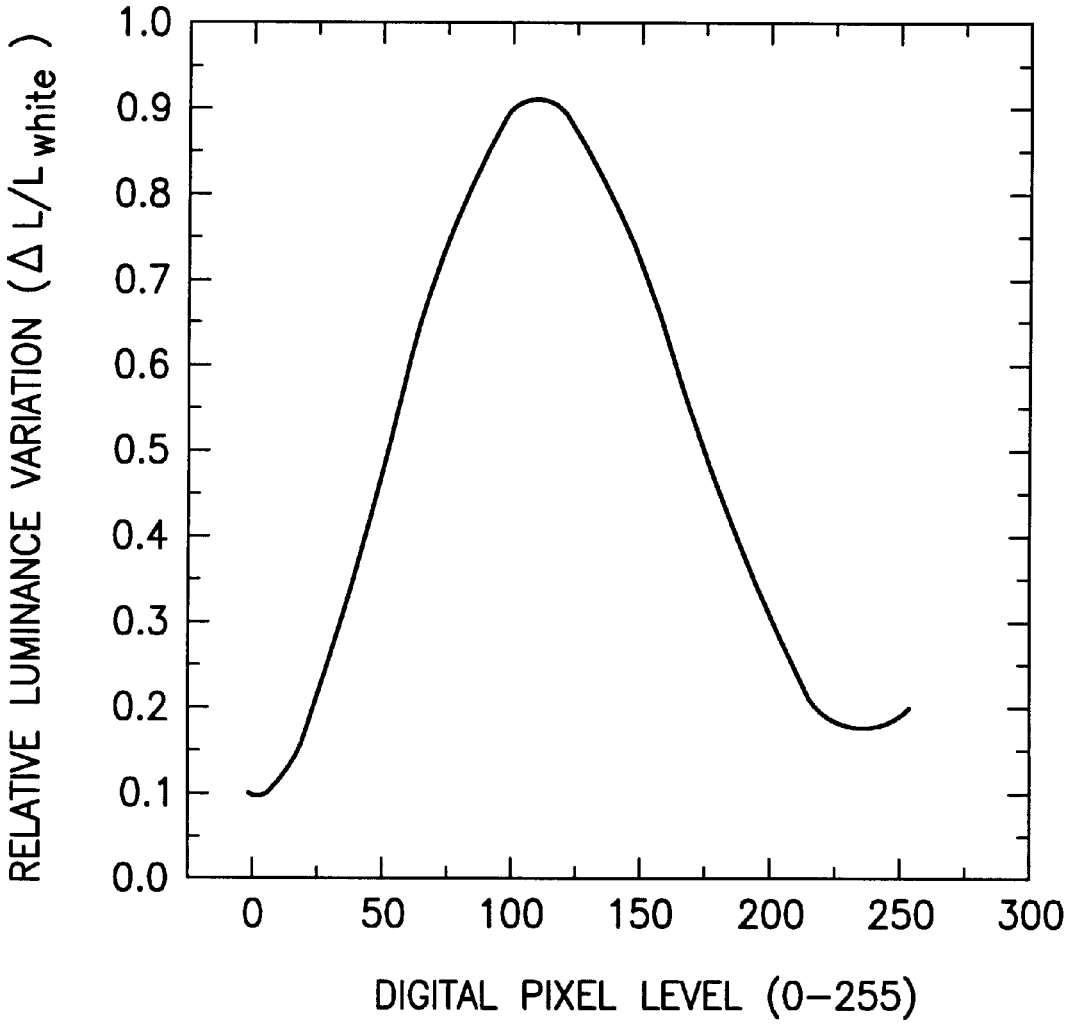
FIG. 2 is a graph illustrating the relative luminance variation over a range of viewing angles as the intensity value decreases from the bright state to the dark state.

Similar transmission characteristics for twisted-nematic mode liquid crystals are shown as FIG. 2b and FIG. 3b in U.S. Pat. No. 5,489,917 to Ikezaki, et al., in which level reversal phenomena are exhibited in upward and downward directions dependent upon the exact liquid crystal mode. A general feature of the characteristics shown in FIG. 11 and in Ikezaki is that for a given set of viewing angle conditions and range of pixel levels, the luminance error associated with level inversion peaks somewhere in the mid-tone graylevel region, that is for pixel levels somewhere between the minimum and maximum.

Figure 12:
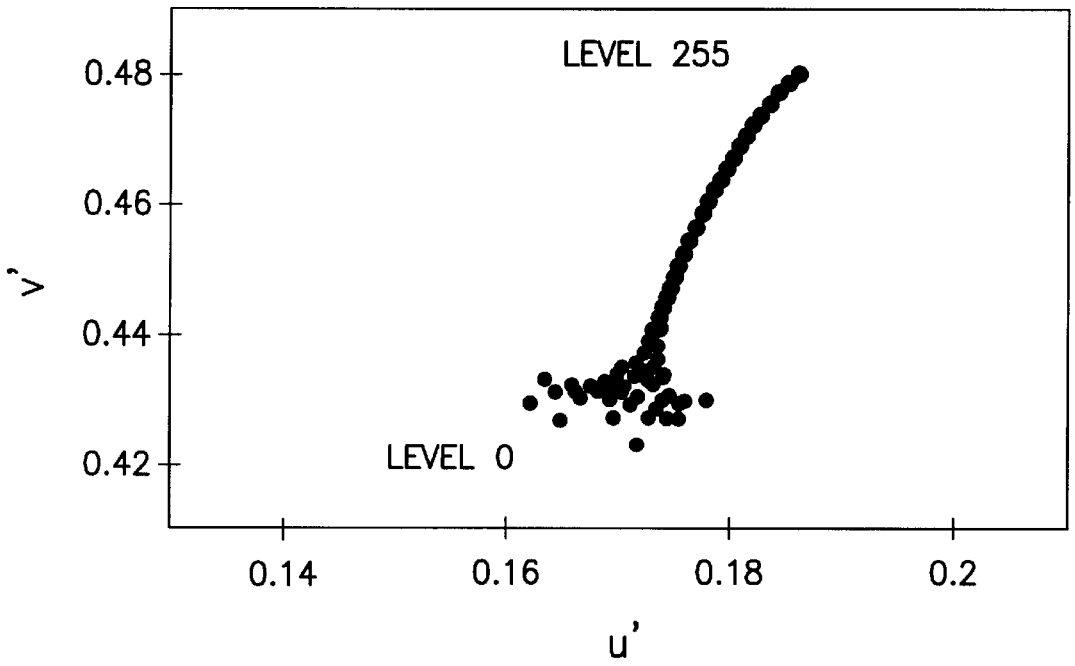
FIG. 12 is a graph of the yellow-blue shift of a typical TN-mode TFTLCD for uniform gray with R=G=B.

Another aspect of most liquid crystal display modes is the color variation which occurs with pixel level. Typical characteristics of twisted-nematic mode are shown in FIG. 12, in which the chromaticity is plotted versus graylevel, for the condition that all three subpixels have the same level, R=G=B. The value u' is indicative of the eye's red-green response, where larger u' values correspond to larger red response. The value v' is indicative of the eye's yellow-blue response, where larger v' values correspond to larger yellow response. Over the range between fully bright (level 255) and fully dark (level 0) the change in v' is larger than u', such that the chromaticity changes from yellowish at level 255 to bluish at level 0. This yellow-blue shift is typical of most liquid crystal display modes. For images which contain a significant number of bright pixels, the appearance of color occurs relative to the white state, which acts as a reference illuminant. The change in chromaticity will be judged as a color shift toward the blue as the level is decreased. Provided the display has a large contrast ratio, that is, the luminance of the bright state is much larger than the luminance of the dark state, the color shift will be most noticeable for the mid-tone graylevels. The bluish condition of fully dark pixels near level 0 cannot be discerned relative to white; they appear black because their luminance is sufficiently low. However, the bluish condition of mid-tone gray pixels can be discerned relative to white because luminance of the mid-tone graylevels is significant compared to fully bright pixel luminance.

In the present invention, these undesirable effects are removed by decreasing the number of image pixel values which have mid-tone levels. This is done by processing pixel data values to produce a halftone image, in which one group of pixels is made brighter than the input values and another group of pixels is made darker than the input values. The pixel data values can be chosen in such a way that the luminance is locally preserved in the image. Both the bright and dark pixels have more desirable viewing angle characteristics than the mid-tone gray pixels which would otherwise be present in the image. The viewing angle characteristics will be dominated by the bright pixels, which are much more visible than the dark pixels. In this way, it can be thought that the luminance viewing angle characteristics of a halftone image approaches that of the bright pixels, simply masked by the presence of dark pixels which reduce the overall luminance relative to the brightness of the individual bright pixels.

A necessary constraint on the groups of pixels is that the group of bright subpixels must contain approximately equal numbers of positive and negative subpixels, as determined by the inversion method used to drive the panel. To minimize flicker and image sticking phenomena, it is necessary to change the polarity of pixel voltages every subsequent frame. Furthermore, to further improve the image quality, including suppression of capacitive crosstalk effects, it is beneficial to alternate the polarity of pixels within the array. Frame inversion is defined to be the case that all pixels in the array are the same polarity within the same frame, alternating in subsequent frames. Column inversion is define to be the case that the pixel voltages alternate between columns within the array and also alternate between frames. Row inversion is the case that the pixel voltages alternate between rows within the array and also alternate between frames, as shown in FIG. 13. Dot inversion combines alternation of pixel voltage polarity with both row and column and between frames as shown in FIG. 14. Typically, at present, commercially-available notebook computer TFTLCDs are driven using row inversion, while present desktop monitor TFTLCDs are driven using dot inversion.

To satisfy the requirement that flicker is not observed, the bright subpixel voltages must be approximately evenly split between positive and negative values. The balance of positive and negative pixels should be matched, consistent with the ability of the human visual system to perceive flicker. The balance must be achieved over a region smaller than the minimal area over which the human visual system can perceive flicker. Other issues of image sticking and crosstalk suppression also place requirements on balance of pixel voltages. All of the requirements are satisfied if the number of positive and negative pixels are balanced within a few percent, and the size of the region over which the balance is achieved is between 1 and 10 pixels.

A wide range of halftone pixel patterns can be used which satisfy the inversion requirements, by nearly balancing the number of bright positive and negative pixels. The patterns can exactly balance the number of bright and dark pixels, in which 50% of the pixels are bright and 50% are dark, or some other ratio of bright and dark pixels, such as 66% dark pixels and 33% bright pixels. The simplest patterns are uniform over the entire panel image. The patterns could also be stochastic, adapting to the image content by changing frequency and pattern as regions of the image change.

It should be understood that the intensity of the halftone patterns in different regions depends upon the image content in those regions. The patterns will have the same overall appearance only if the image content is changing gradually from pixel to pixel. If the image content is changing sharply from pixel to pixel, then the halftone pattern will be disrupted. To describe the different patterns, for the purposes of the following discussion, it is assumed that the image data is uniform from pixel to pixel, such as a mid-level gray color.

Figure 15:
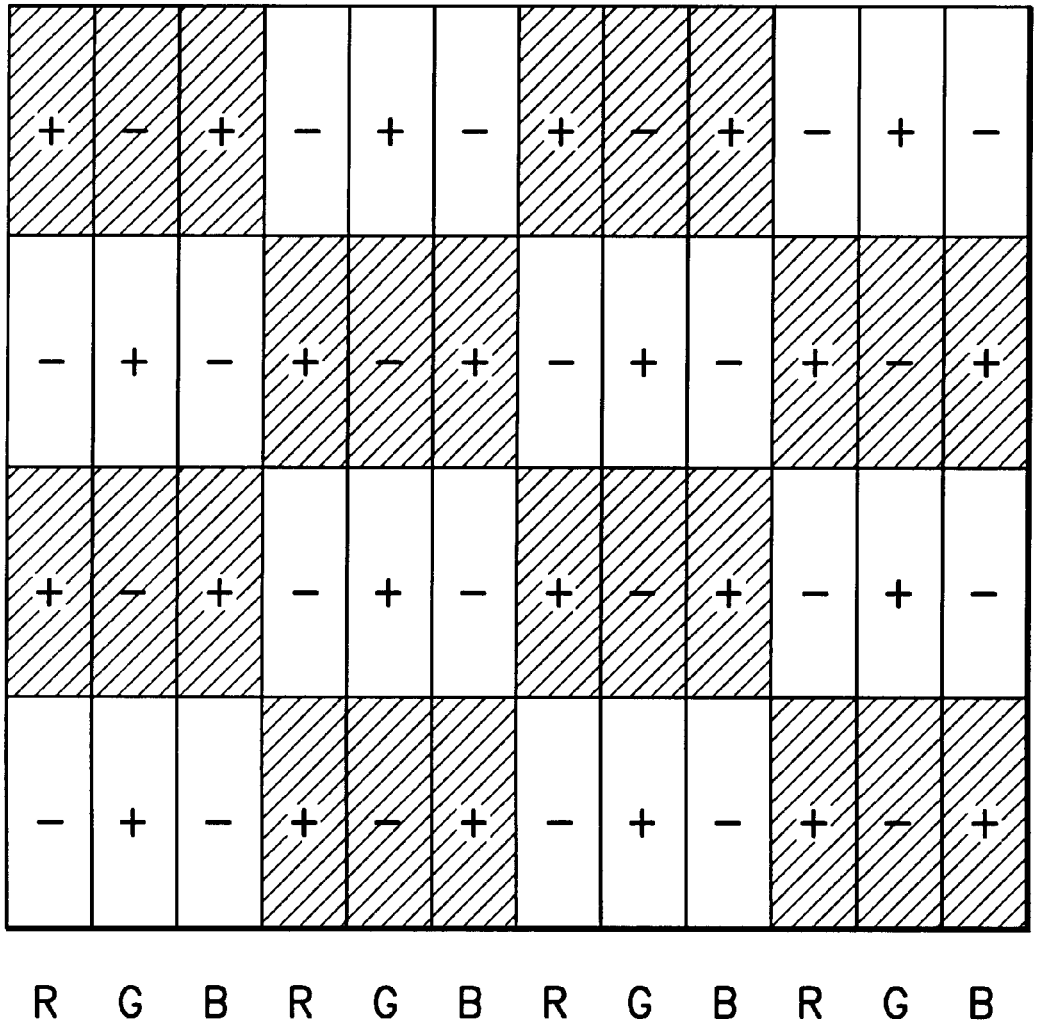
FIG. 15 is an illustration of a full pixel 2×2 pattern, with dot inversion.

Examples of uniform patterns are now described. One of the simplest patterns is a 2×2 full pixel checkerboard, shown in FIG. 15. In this pattern, each full pixel, consisting of three subpixels R, G, and B is made either dark or bright. The full pixels alternate between dark and bright. Under row inversion, the polarities of all subpixels within each bright pixel are the same, the polarities alternate between rows, and the number of bright positive pixels are exactly matched by the number of bright negative pixels. This pattern is acceptable for panels driven under row inversion. However, under dot inversion, with polarities as shown in FIG. 15, it is seen that the number of bright positive and bright negative pixels is not balanced.

Figure 16:
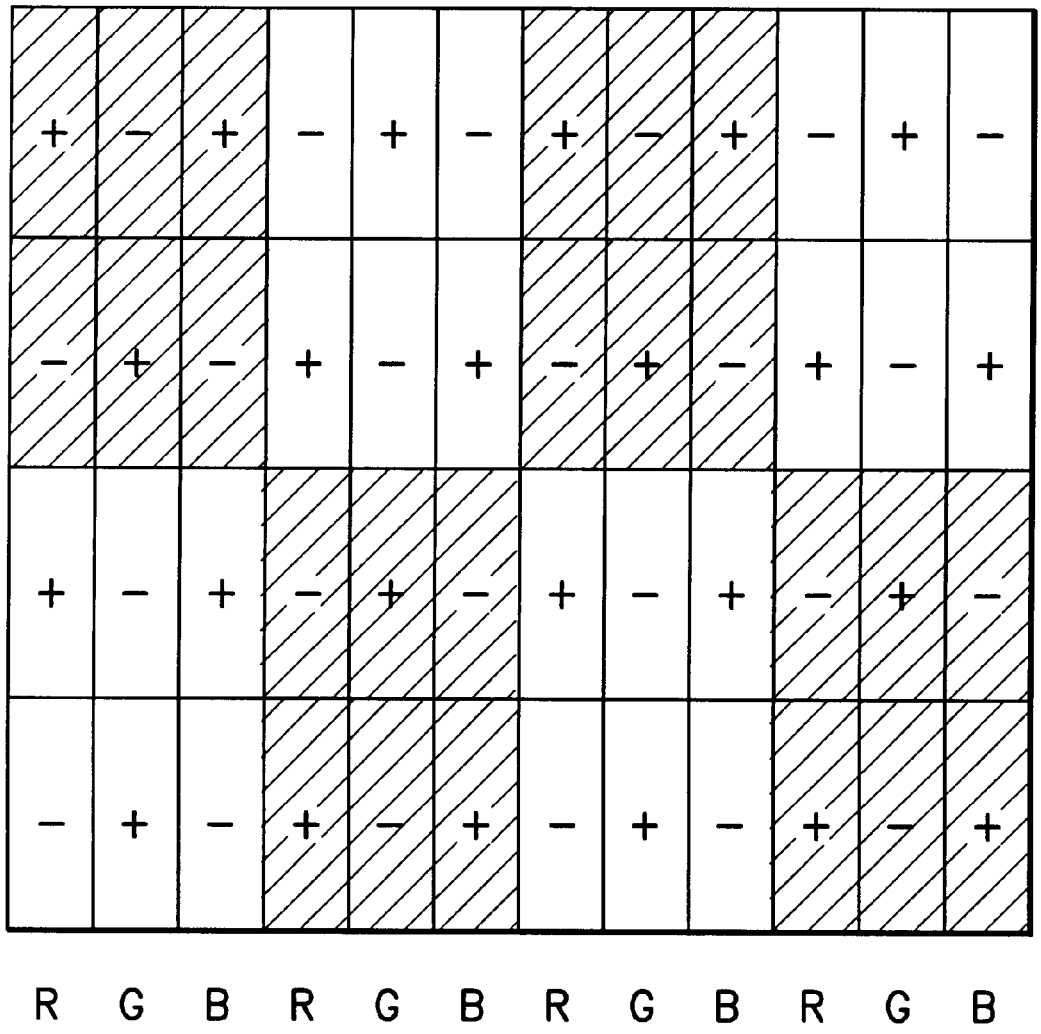
FIG. 16 is an illustration of a full pixel 2×4 pattern.
Figure 17:
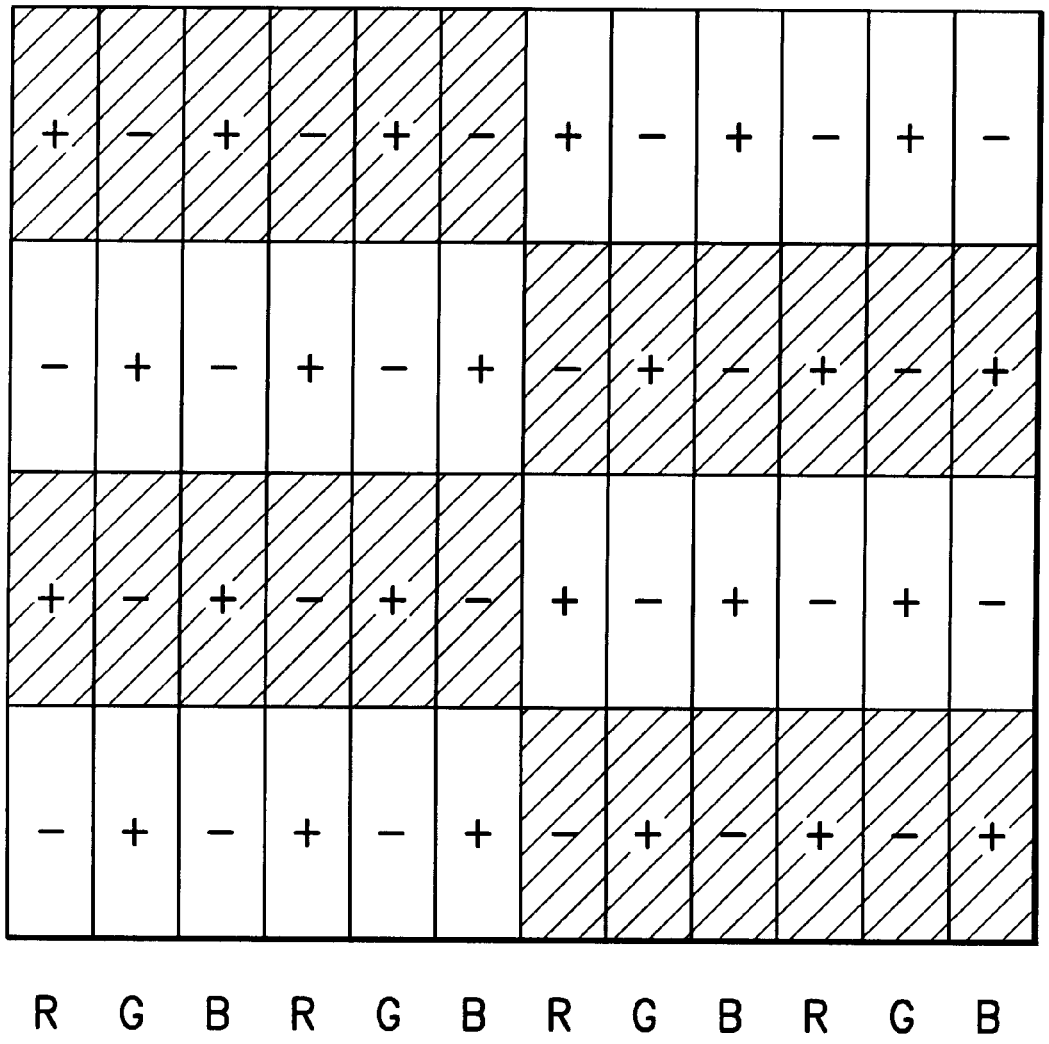
FIG. 17 is an illustration of a full pixel 4×2 pattern.
Figure 18:
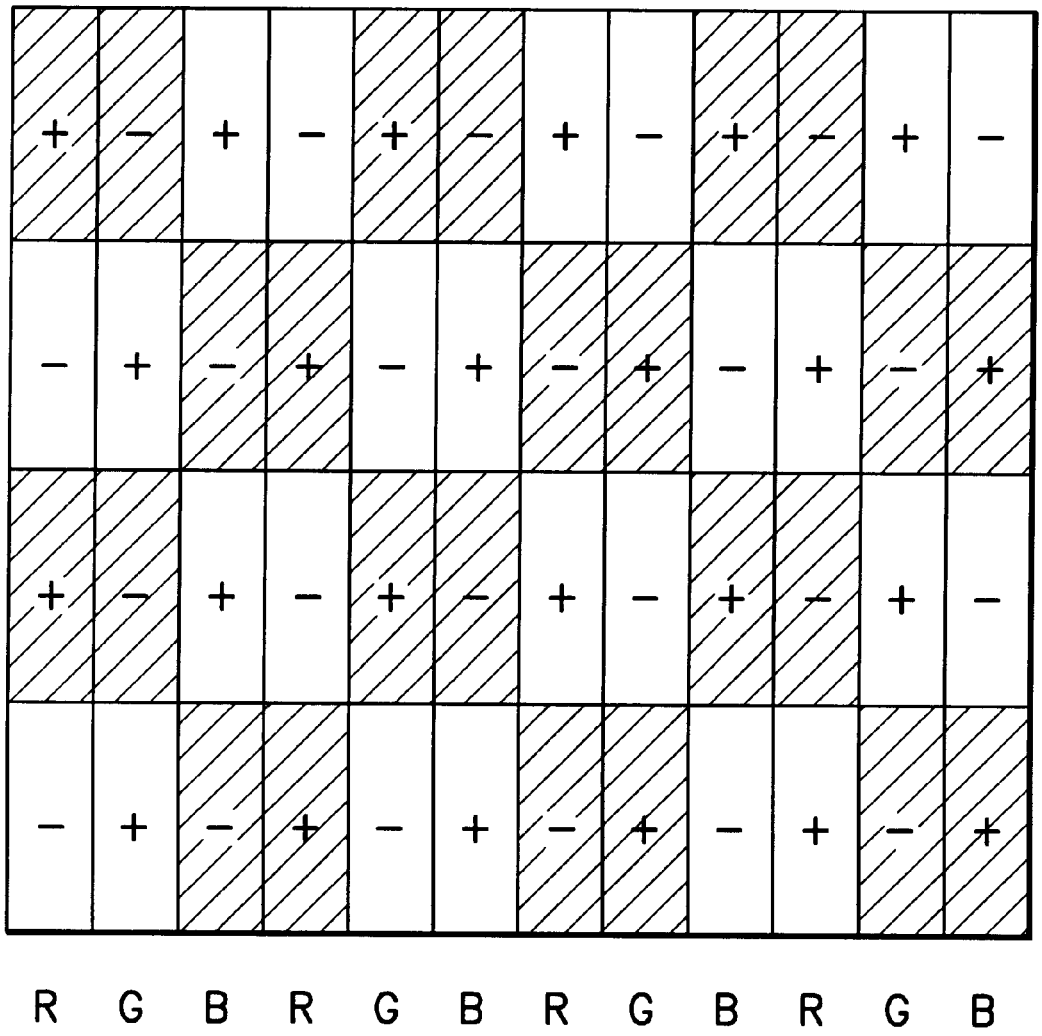
FIG. 18 is an illustration of a 4×2 double subpixel pattern.
Figure 19:
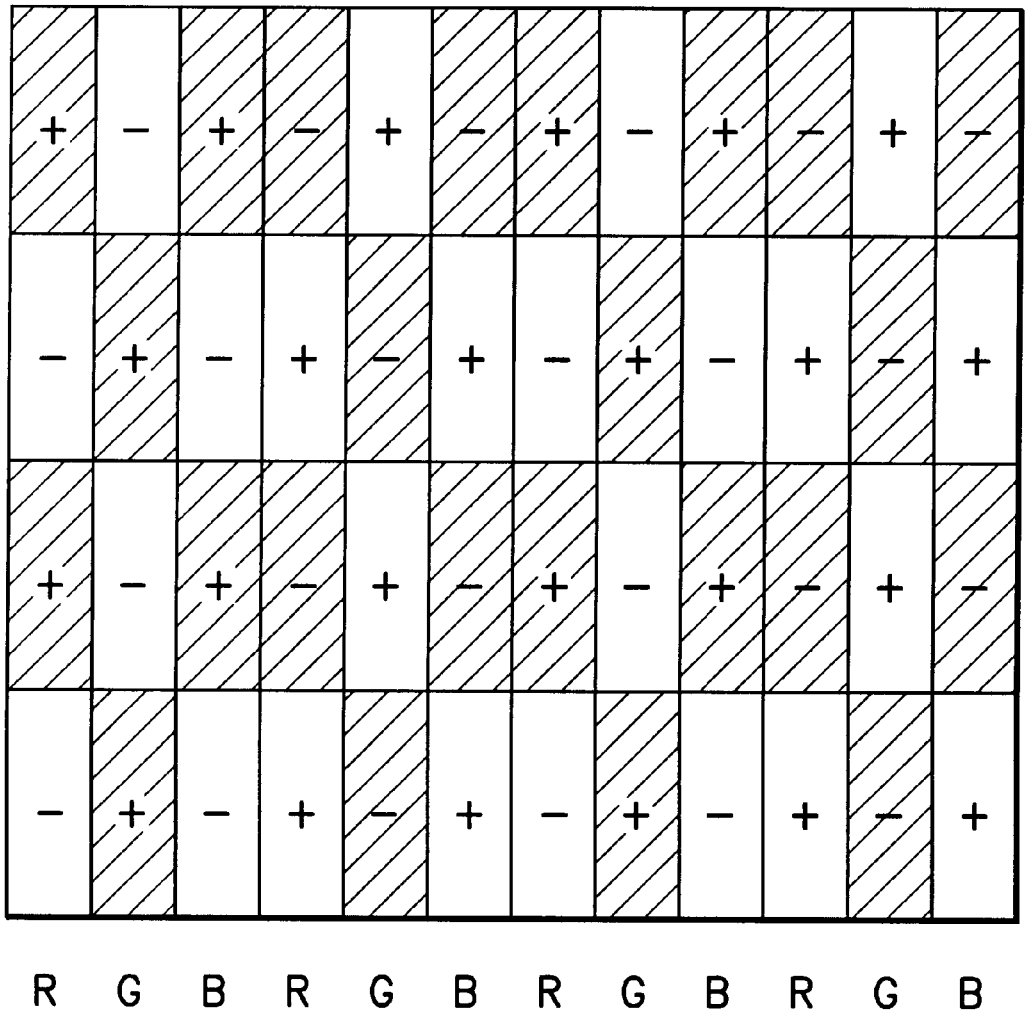
FIG. 19 is an illustration of a 2×2 subpixel pattern with a green/magenta arrangement.

Patterns which exactly balance the number of bright positive and bright negative pixels under both row inversion and dot inversion are shown in FIG. 16, FIG. 17, FIG. 18, and FIG. 19. All patterns in these figures also share the property that exactly half the pixels are darkened and half the pixels are brightened. FIG. 16 illustrates a full pixel 2×4 pattern, in which the periodicity is 2 pixels in the horizontal direction and 4 pixels in the vertical direction. The brightened or darkened regions consist of a full pixel. FIG. 17 illustrates a full pixel 4×2 pattern, in which the periodicity is 4 pixels in the horizontal direction and 2 pixels in the vertical direction. The brightened or darkened regions consist of a full pixel. FIG. 18 illustrates a double subpixel 4×2 pattern. The brightened or darkened regions consist of a pair of subpixels. FIG. 19 illustrates a subpixel 2×2 pattern. The periodicity is 2 pixels in both horizontal and vertical directions. The brightened or darkened regions consist of either a single subpixel or a pair of subpixels. There are three possible color arrangements for the subpixel 2×2 pattern, namely green/magenta, red/cyan, and blue/yellow. The green/magenta color arrangement is depicted in FIG. 19.

Examples of patterns with much larger repeat distances are shown FIG. 20 and FIG. 21. These patterns can be described as staggered subpixel 14×14 patterns. These patterns have a periodicity of 14 full pixels in both the horizontal and vertical directions, with a total of 588 subpixels in each repeated pattern. In FIG. 20, the bright subpixels constitute 57.1% of the total number of subpixels within the repeated pattern, with equal numbers of subpixels with opposite polarity. The dark subpixels constitute 42.9% of the total, also with equal numbers of subpixels with opposite polarity. The pattern shown in FIG. 21 is similar to that just described, except that the dark subpixels and bright subpixels constitute 57.1% and 42.9% of the total, respectively.

From the description of these patterns, it is clear that many possible uniform patterns can be constructed which satisfy the required conditions for this invention.

Figure 22:
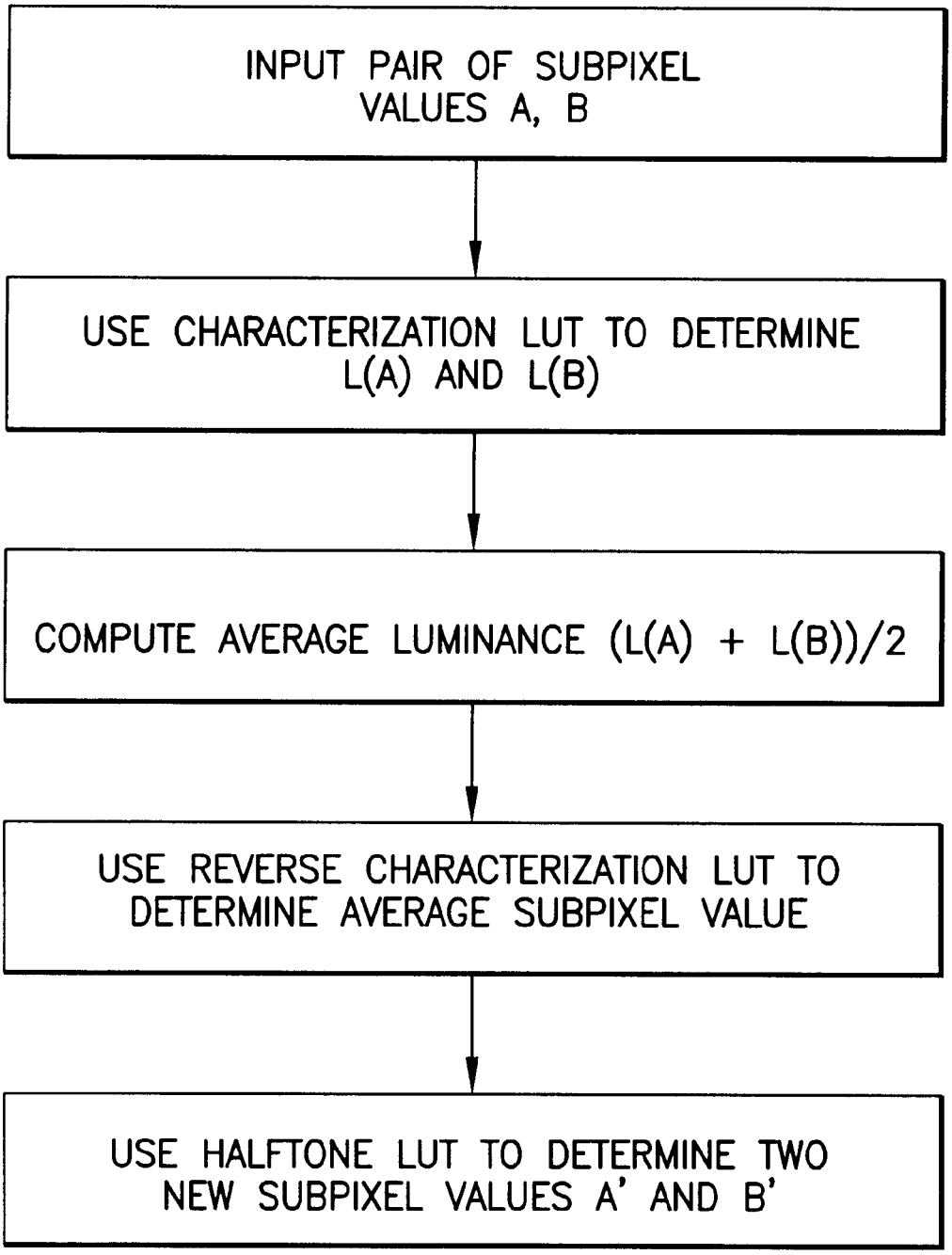
FIG. 22 is a general flow chart of halftone pixel processing.

Most of these patterns can be created in the display image data by processing pairs of pixels within the same row in the image data, moving through the pixel data on a row by row basis. Some patterns may also require that pixels in adjacent rows be processed together. In that case, an entire line of pixel values must be stored in a line buffer. If a small number of pixels can be processed together in groups with a small number of operations, the pixel data can be processed rapidly, at a rate compatible with refresh frame rates for the display. A description of pairwise pixel processing flow within the same row is shown in the flow chart in FIG. 22.

Figure 23:
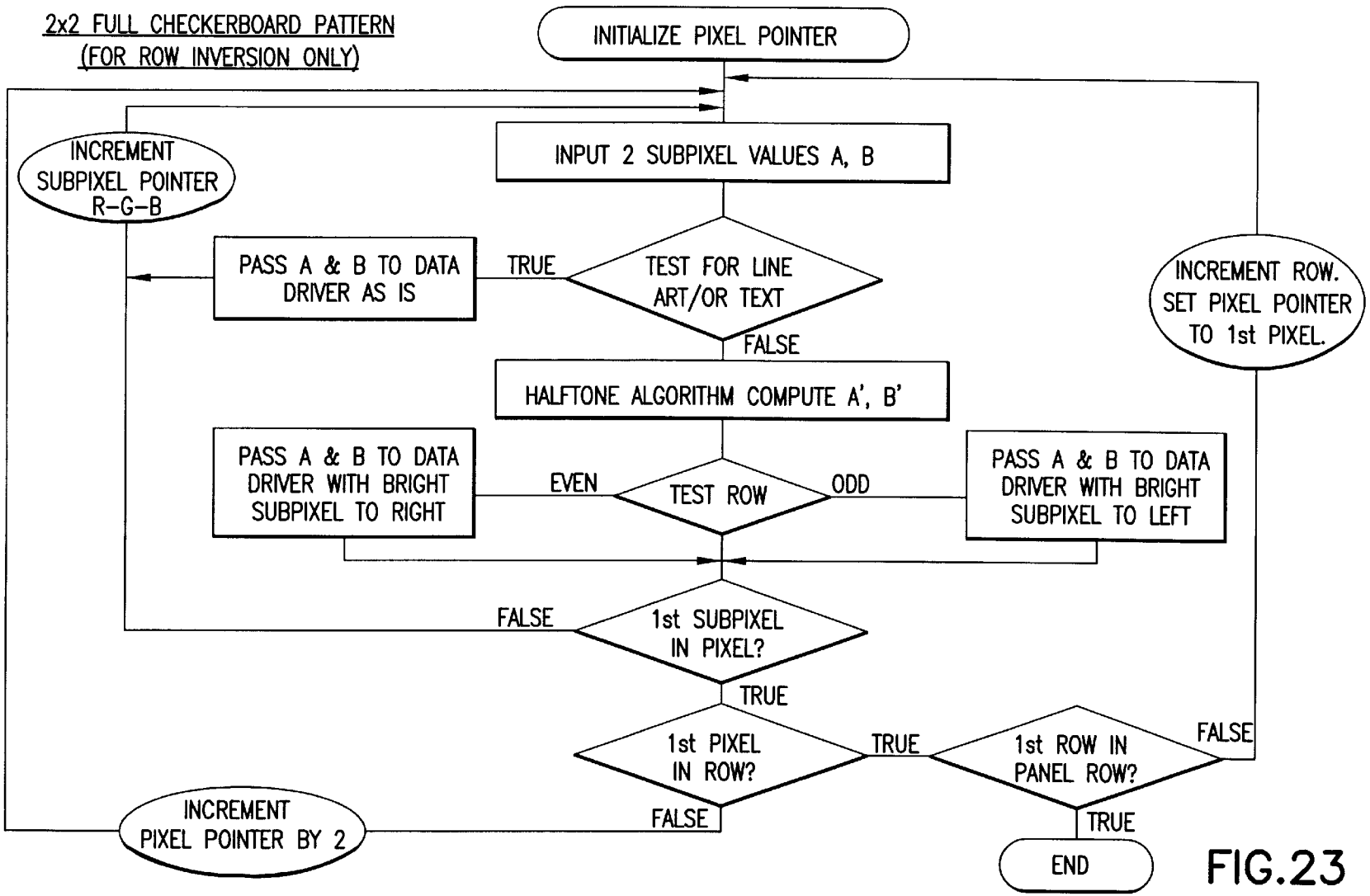
FIG. 23 is a flow chart for full pixel 2×2 pattern.

FIG. 23 shows an example flow chart of how the pixel data could be processed for the 2×2 full pixel checkerboard pattern shown in FIG. 15. The first step is to determine whether or not the first pixel in the row is to be skipped. If the pixel row is even, the first three subpixels are ignored, and the starting point is shifted by 1 full pixel within the row. If the pixel row is odd, retain the starting point at the 1st pixel in the row. Store the pair of subpixel level values in the row, starting at the pointer location and including the adjacent subpixel. Next, to preserve line art and text which contain solid blocks of saturated colors, it is necessary to test for the presence of this material in the image data. If either subpixel is either level 0 or 255, the subpixel level values at this location remain unchanged by the algorithm. Alternatively, a threshold test could be used for the subpixels which prevents changing the pixel level values when the difference between input subpixel level values is larger than a threshold level value. A suitable threshold difference is about 100 levels. Next, the two values of pixel luminance are determined for the pair of pixel levels using a characterization lookup table (LUT). The characterization LUT is simply the calibration curve of the pixel luminance versus pixel level. If the panel characteristics can be described by a simple mathematical relationship, then LUT #1 could be formula. The average luminance of the pair of pixels is then calculated. Next, using LUT #1 in reverse, the target average level is determined as that pixel level which corresponds to the average luminance of the pair of pixels. Finally, the two new DAC levels are then determined for the pair of pixels, using an algorithm LUT. The algorithm LUT is the halftone algorithm curve. The optimal halftone algorithm curve will be different for different calibration curves and different liquid crystal display technologies.

Figure 24:
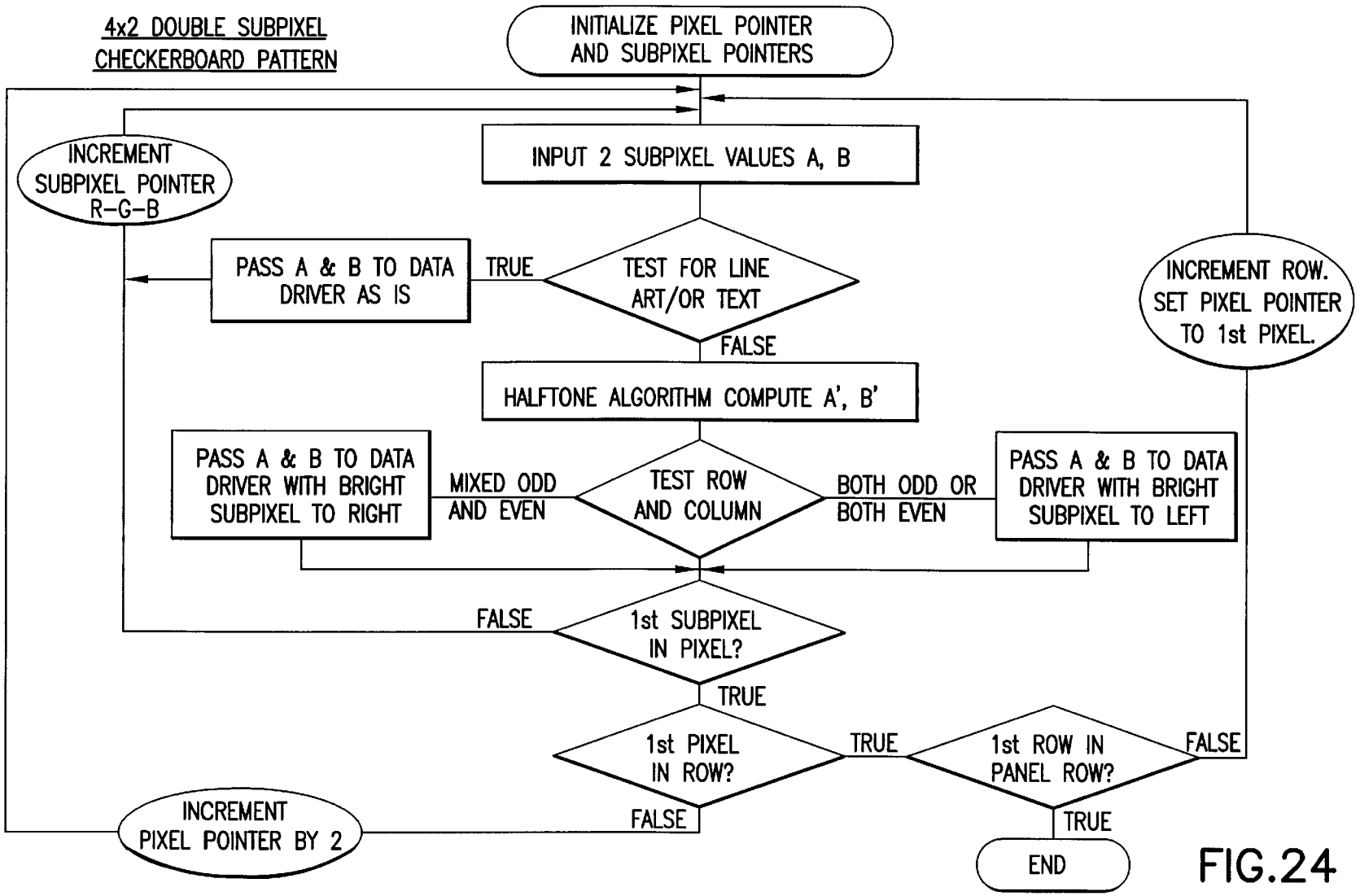
FIG. 24 is a flow chart for double subpixel 4×2 pattern.
Figure 25:
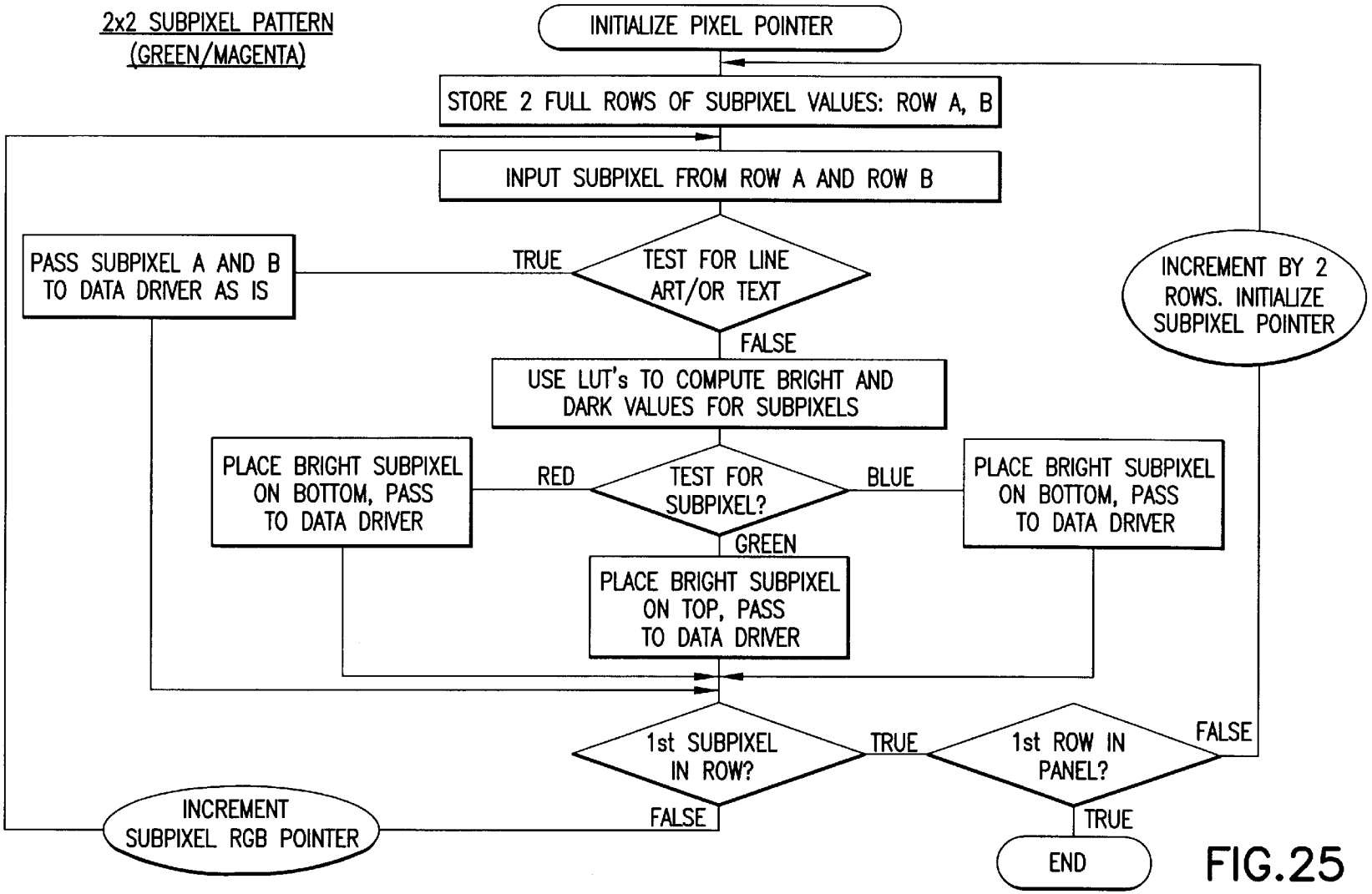
FIG. 25 is a flow chart for 2×2 subpixel pattern, where pixels are processed within the same column.

A different flow chart for the generation of the double subpixel 4×2 pattern in FIG. 18 is shown in FIG. 24. The general characteristics are the same as for the flowchart in FIG. 23, but with different branching conditions. Both of the flow charts in FIG. 23 and FIG. 24 involve processing pairs of pixel data within the same row in the image. An example of a flow chart which involves processing pairs of pixel data within the same column, but with different rows is given in FIG. 25. This flow chart describes the process generation of the 2×2 subpixel pattern shown in FIG. 19.

For good performance of information displays, a gamma-type transfer curve, as described in Equation (1), is desired. Most commercial cathode-ray-tube displays have gammas in the range 2.2 to 2.8, and a gamma of 2.2 is generally the desired target value. We now consider the case that the display transfer characteristics follow a gamma-type curve, with a negligibly small minimum luminance, $Y_{min}$. The transfer characteristics are then:

$$Y=Y_{max}\cdot(n/255)^{\gamma} \qquad \text{Eq. (3)}$$

For the following discussion, we consider a pattern in which exactly one half of the pixels are bright and one half are dark. We desire to match the macroscopic luminance of the halftone pattern to that of a uniform pattern. For a uniform pattern, in which all pixels have the same level, the microscopic pixel luminance is the same as the macroscopic luminance. The macroscopic luminance of the halftone pattern is given by:

$$Y_{ht} = \frac{1}{2}Y_{\max}\cdot\left(\frac{n_d}{255}\right)^{\gamma} + \frac{1}{2}Y_{\max}\cdot\left(\frac{n_b}{255}\right)^{\gamma} \qquad \text{Eq. (4)}$$

where $n_d$ and $n_b$ are the levels of the dark and bright pixels in the halftone pattern.

We first consider that the dark pixels are made as dark as possible, $n_d$=0, with negligible luminance. The macroscopic luminance of this halftone pattern will match the macroscopic luminance of a uniform pattern when the microscopic luminance of the individual bright pixels is exactly twice that of the pixels of the uniform pattern. For a given target level of the uniform pattern, n, we have:

$$Y_{ht} = \frac{1}{2}Y_{\max}\cdot\left(\frac{n_b}{255}\right)^{\gamma} = Y_{\max}\cdot\left(\frac{n}{255}\right)^{\gamma} \qquad \text{Eq. (5)}$$

Solving for $n_b$, we obtain:

$$n_b=n\cdot(2)^{1/\gamma} \qquad \text{Eq. (6)}$$

Under these conditions, the relationship between halftone bright pixel level and target pixel level is linear. For purposes of illustration, the following example is provided. For $\gamma$=2.2, $n_b$=1.37n. Also, for $\gamma$=2.2, the uniform pattern luminance becomes ½ $Y_{max}$ at a pixel level of 186. This luminance can be matched by a halftone pattern with equal numbers of fully bright pixels at level 255 and fully dark pixels at level 0.

For target levels larger than 186, the halftone bright pixels have saturated at level 255, and to match the target level luminance, the level of the dark pixels must be increased above 0.

$$Y_{\max}\cdot\left(\frac{n}{255}\right)^{\gamma} = Y = Y_{ht} = \frac{1}{2}Y_{\max}\cdot\left(\frac{n_d}{255}\right)^{\gamma} + \frac{1}{2}Y_{\max}\cdot\left(\frac{255}{255}\right)^{\gamma} \qquad \text{Eq. (7)}$$

The solution for the dark pixel levels becomes:

$$n_d = 255\cdot\left[2\cdot\left(\frac{n}{255}\right)^{\gamma} - 1\right]^{(1/\gamma)} \qquad \text{Eq. (8)}$$

Figure 26:
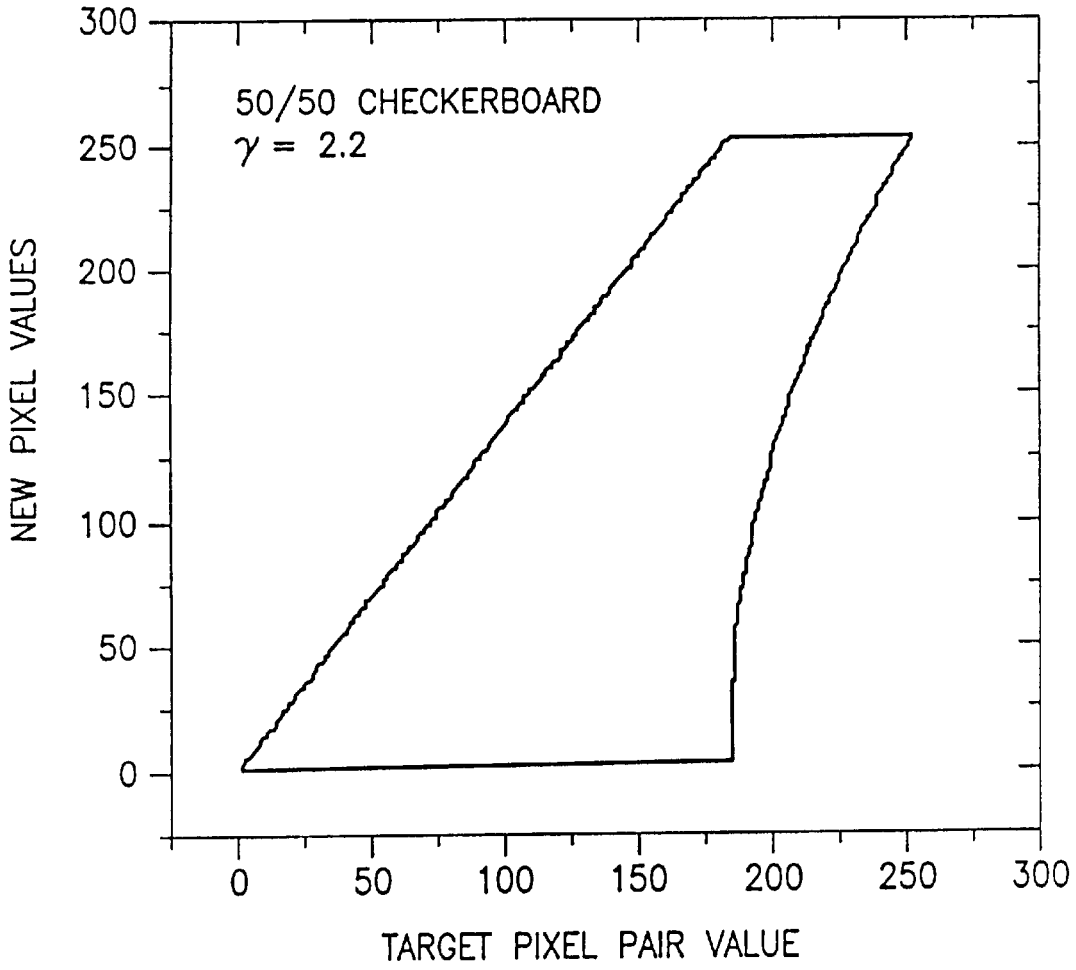
FIG. 26 is a graph illustrating a linear halftone relationship for ideal gamma characteristics.

This relationship of bright and dark halftone pixel values to the target level, referred to as the linear algorithm, is shown in FIG. 26. An undesirable aspect of this algorithm is the presence of sharp corners in the curves for bright and dark pixel values, occurring near the point of 50% luminance. Images on liquid crystal displays processed with this algorithm typically exhibit luminance banding and strong color shifts for luminances near 50% of maximum. Through suitable functional modifications to the algorithm, the sharp corners in the curves can be smoothed. Examples of suitable functions include power-law and complementary error functions. A power-law relationship has been explored experimentally, and found to have reduced luminance banding and color shifts as compared to the linear algorithm. Although the maximum spread in bright and dark branches of the output DAC values is achieved with the linear algorithm, better results have been obtained with a power law algorithm. This power-law relationship is described next.

We again consider a panel with ideal gamma-law transfer characteristics, as given in Equation 3. For a power-law relationship, a convenient way to define the dark branch of the halftone pixel pair is to define the dark pixel DAC value $n_d$ as a power law relationship to the target DAC value, n, with an exponent p, $$n_d = 255\cdot\left(\frac{n}{255}\right)^{p} \qquad \text{Eq. (9)}$$

so that the luminance of the dark subpixels, $Y_{dark}$, is given by:

$$Y_{dark} = Y_{\max} \cdot \left[ \frac{255 \cdot \left(\frac{n}{255}\right)^{p}}{255} \right]^{\gamma} = Y_{\max} \cdot \left(\frac{n}{255}\right)^{p\gamma} \quad \text{Eq. (10)}$$

The sum of the luminances of the dark and bright pixels must equal the luminance of the target DAC value, normalized to take into account that each of the pixel pairs occupies one half of the surface area.

$$2Y = 2Y_{\max} \cdot \left(\frac{n}{255}\right)^{\gamma} = Y_{dark} + Y_{bright} = Y_{\max} \cdot \left(\frac{n}{255}\right)^{p\gamma} + Y_{bright} \quad \text{Eq. (11)}$$

Solving for $Y_{bright}$:

$$Y_{bright} = Y_{\max} \cdot \left[ 2\left(\frac{n}{255}\right)^{\gamma} - \left(\frac{n}{255}\right)^{p\gamma} \right] = Y_{\max} \cdot \left(\frac{n_b}{255}\right)^{\gamma} \quad \text{Eq. (12)}$$

Solving for $n_b$:

$$n_b = 255 \cdot \left[ 2\left(\frac{n}{255}\right)^{\gamma} - \left(\frac{n}{255}\right)^{p\gamma} \right]^{1/\gamma} \quad \text{Eq. (13)}$$

If the power p=1, then the bright and dark subpixel luminances are the same, that is, there is no halftoning. As the power p is increased the luminance of the dark subpixels is lowered, and the luminance of the bright subpixels is raised, following curves which can be called the dark and bright branches, respectively. If the power p is made too large, then for target DAC values near to 255, the luminance of the dark branch is too small, such that the required luminance of the bright subpixels would exceed full brightness, at least for certain values of n. In this case, the maximum error occurs for DAC values somewhat below level 255. At present, there is no known analytical solution for the maximum value of p which will not result in any luminance error, but the value of p can be found numerically. For example, if γ=2.2, then the maximum value of p is 2.01. Further numerical study shows that the error increases quite slowly as p is increased beyond 2.01. Since the viewing angle characteristics generally improve as the separation between bright and dark branches is increased, it is desirable to increase the value of p, as long as the luminance error introduced is acceptable.

Figure 27:
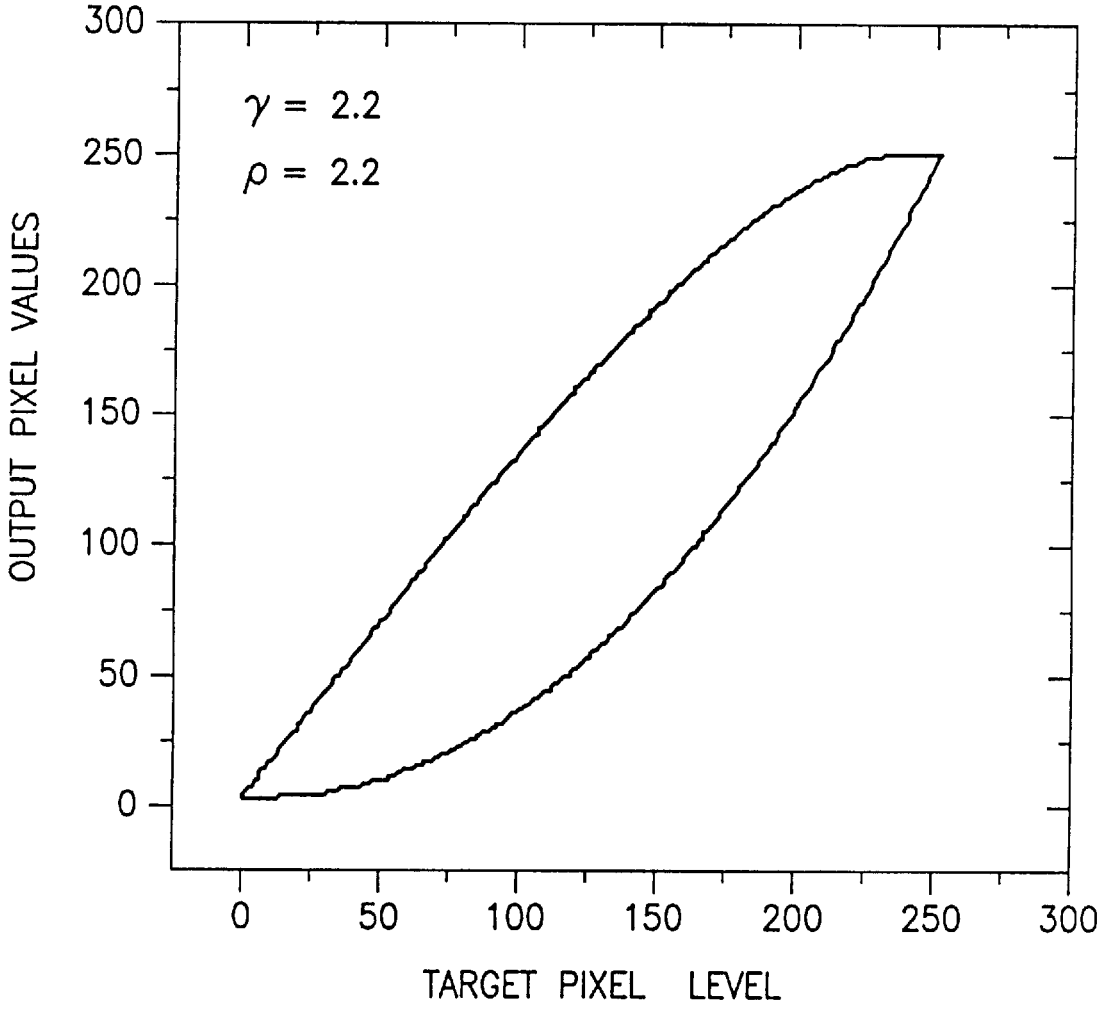
FIG. 27 is a graph illustrating a power-law halftone relationship for ideal gamma characteristics.

A summary of the error introduced for different values of p is shown in Table 1, for γ=2.2. The range over which error occurs is shown, with the average value within that range, the maximum error and the DAC value at which the maximum error occurs. The human visual system can detect luminance differences of approximately 0.5 to 1.0%, for patches of light which are in close proximity. Without side-by-side comparisons, errors of up to several percent are probably acceptable, because the overall effect on the gamma curve transfer characteristics will not be noticeable in images. The average and maximum errors for p=2.4 are about 1%, gradually increasing to between 3 and 4% for p=3.0. Examples of light and dark branches of the power-law algorithm are shown in FIG. 27.

TABLE 1

Summary of power-law errors for γ = 2.2.

| power | error range | avg error | max error | max error location |
|---|---|---|---|---|
| 2.01 | (none) | 0 | 0 | — |
| 2.1 | 245–254 | 0.0007 | 0.0011 | 250 |
| 2.2 | 237–254 | 0.0026 | 0.0038 | 246 |
| 2.3 | 230–254 | 0.0051 | 0.0076 | 243 |
| 2.4 | 225–254 | 0.0083 | 0.0121 | 240 |
| 2.5 | 220–254 | 0.0115 | 0.0171 | 238 |
| 2.6 | 216–254 | 0.0149 | 0.0223 | 237 |
| 2.7 | 213–254 | 0.0187 | 0.0277 | 235 |
| 2.8 | 210–254 | 0.0223 | 0.0332 | 234 |
| 2.9 | 208–254 | 0.0262 | 0.0388 | 234 |
| 3 | 205–254 | 0.0294 | 0.0443 | 233 |

The errors can be suppressed by a suitable combination of linear algorithm and power-law algorithm DAC values. Specifically, the dark branch DAC levels can be the power-law values below the range in which error occurs, and linear algorithm values within the range where errors would normally occur with the power-law algorithm.

Figure 28:
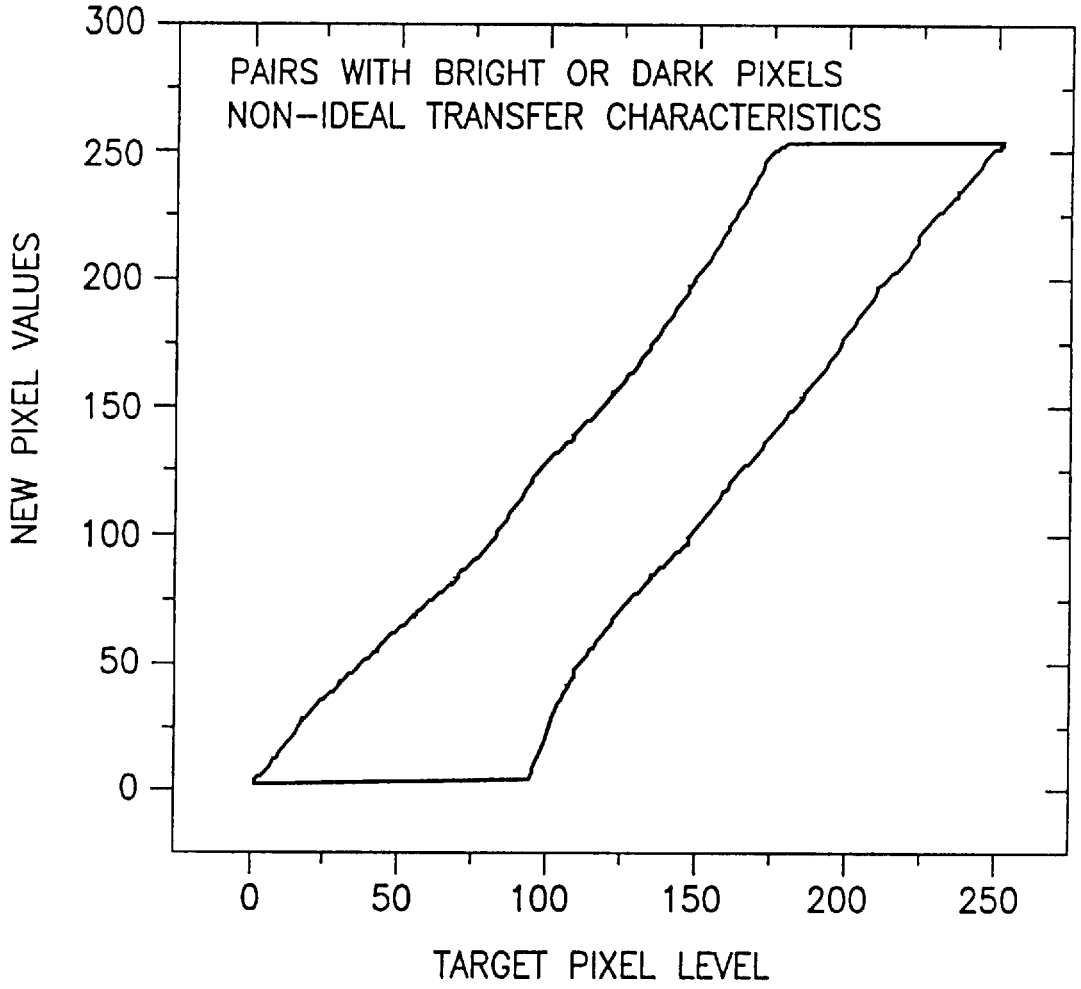
FIG. 28 is a graph showing improved linear halftone relationship for lookup table for typical TN-mode panel transfer characteristics.

As shown in FIG. 4, typical liquid crystal display panels do not exhibit ideal gamma-type transfer characteristics. The algorithms previously described can be applied to the non-ideal transfer characteristics, which will result in halftone image characteristics which are also non-ideal. This could be done by calculating all halftone pixel levels based on the known luminance values of the panel, instead of a formula based on ideal characteristics. In FIG. 28, an example of linear algorithm levels is shown, applied to a typical panel with non-ideal display transfer characteristics, such at that shown in FIG. 6.

An alternative is to first modify the pixel data input to the panel to correct for the inherent non-ideal transfer characteristics, and achieve ideal gamma-law transfer characteristics. To do this, a gamma-correction LUT is constructed to change the input levels to new levels such that the output characteristics now follow an ideal gamma law characteristic. The gamma-correction LUT can be combined with the algorithm LUT so that gamma correction and halftone algorithm generation are done in one operation.

For target macroscopic luminances less than 50% of maximum, an upper limit for the luminances of the bright halftone pixels is easily established. Assuming negligible luminance of the dark state, for any target macroscopic luminance, the luminance of the bright pixels cannot exceed the target luminance by more than a factor of two. This follows simply as a consequence that the luminance of the dark halftone pixels cannot be smaller than zero. Taking into account nonzero luminance of the dark state, the theoretical upper limit for bright halftone pixel luminance is somewhat less than twice the target luminance. This condition establishes the maximum allowable separation between bright and dark branches of the halftone pixel levels.

Experiments have shown that the best viewing angle characteristics are obtained when the difference between bright and dark branches of the curve are somewhat less than the maximum separation which is allowed. Reductions in color variation and pattern visibility also occur as the separation between the two branches is reduced. Semi-empirical methods can be used to establish several algorithm curves which optimize one aspect of the image quality or another. These curves may be user-selectable. In general, the curves will follow the shape of the curves in FIG. 26 or FIG. 27, with different degrees of separation between the bright and dark branches, and sharpness of the corners in the transition region near 50% luminance.

Figure 29:
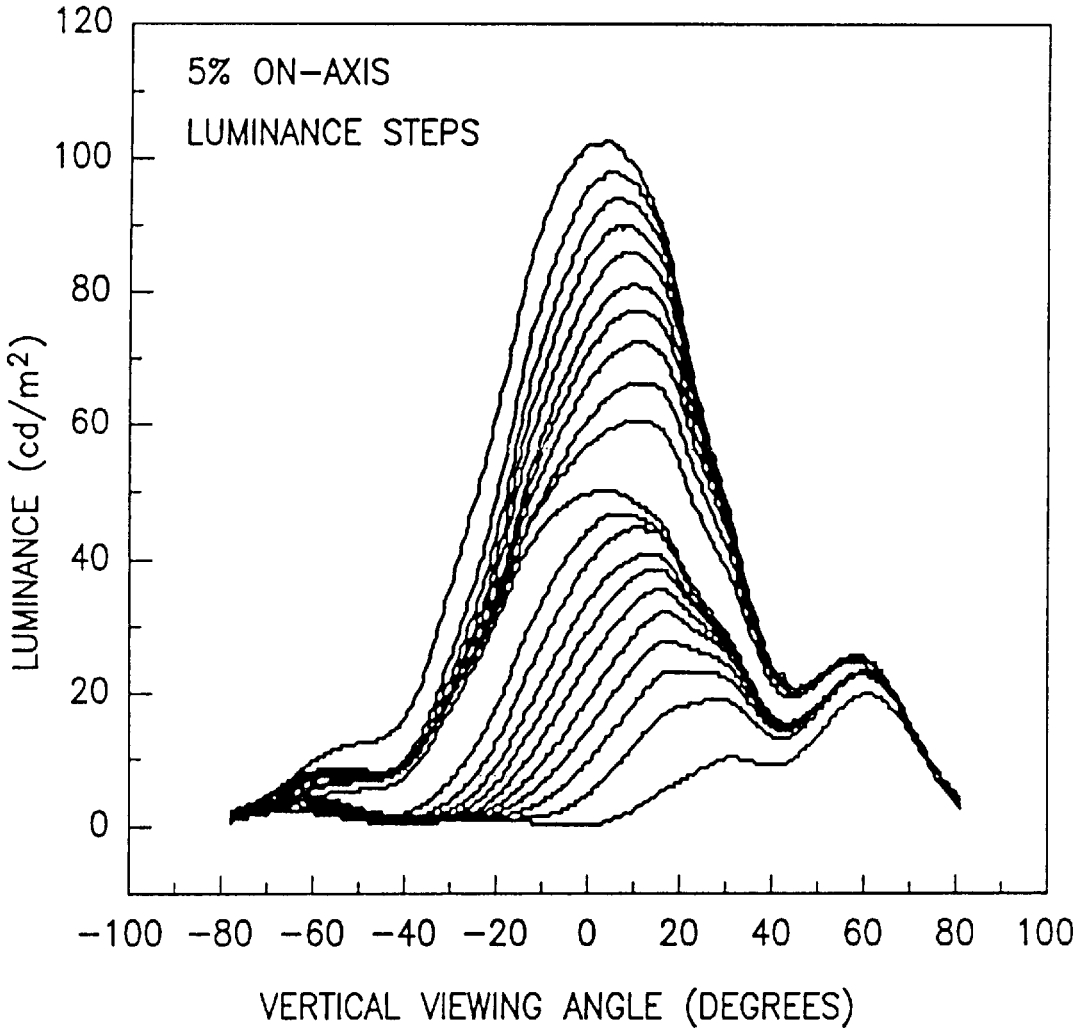
FIG. 29 is a graph showing luminance versus viewing angle for different linear halftone curves.

FIG. 29 shows a plot of measured luminance versus vertical viewing angle characteristics of a TN-mode panel, for a 2×4 double subpixel halftone pattern, using a linear algorithm curve with maximum separation between the bright and dark branches, and pairwise pixel processing. The characteristics are shown for different target luminance values. As the target luminance is reduced from 100%, the viewing angle characteristics initially degrade from the white state condition, with the location of peak luminance shifting away from normal incidence. As the target luminance approaches 50% of maximum, the viewing angle characteristics return to the white state condition, simply scaled from the 100% condition by a factor of two. This is expected, because the 50% luminance condition corresponds to one half the total number of pixels held in the fully bright condition, with the other half held fully dark. As the target luminance is further reduced below 50%, the luminance peak again moves away from normal incidence.

All of the preceding discussion regarding the algorithm details applied to patterns in which exactly half of the pixels are darkened and half of the pixels are brightened in the halftone image. For patterns with proportions of bright and dark pixels other than this, the detailed algorithm must be altered accordingly. The preceding discussion was concerned with the calculation of halftone subpixel values which occur in pairs, that is, a dark subpixel and a bright subpixel. The subpixel pairs which are processed could be contained within the same row (a 2×1 block) or within the same column (a 1×2 block). How the blocks of halftone subpixels are arranged into acceptable patterns was also discussed.

If the pixel density in the array is large enough, approximately 170 pixels per inch or larger, then the viewing angle characteristics can be further improved, without a significantly noticeable reduction in image resolution, by processing 2×2 blocks of pixels, referred to herein as quad pixel processing. With quad blocks containing 4 pixels, the bright and dark subpixel luminance distribution can be refined. The average luminance of a quad block is calculated via the calibration LUT by adding up the 4 subpixel luminances and dividing by 4. The target level is also determined using the LUT in reverse. If all 4 subpixels were held at the target level, the luminance would match the average luminance of the original block of subpixels. If the average luminance is between 75% and 100% of maximum, then one of the 4 pixels in the block is made darker, while the remaining 3 pixels are held at or close to maximum brightness. If the average luminance is between 50% and 75%, then 1 pixel is fully or nearly fully dark, 1 pixel is in an intermediate state, and the 2 remaining pixels are held at or close to maximum brightness. If the average luminance is between 25% and 50%, then 2 pixels are fully or nearly fully dark, 1 pixel is in an intermediate state, and the 1 remaining pixel is held at or close to maximum brightness.

If the average luminance is between 0% and 25%, then 3 pixels are fully or nearly fully dark, and the 1 remaining pixel is at an intermediate state.

Figure 30:
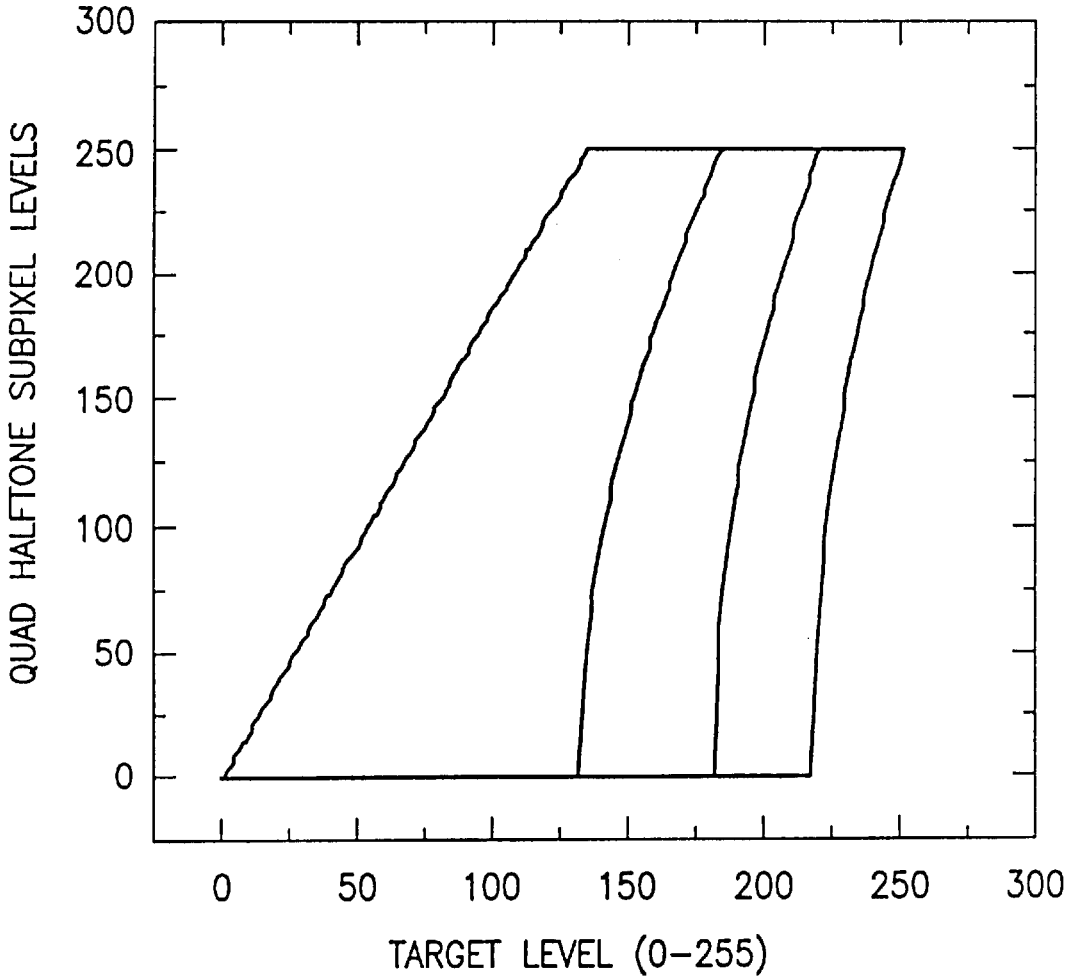
FIG. 30 is a graph illustrating a linear-law algorithm for 2×2 quad pixel processing, with maximal separation between light and dark branches.

An example of an algorithm for quad pixel processing is shown in FIG. 30, in which the separation between the light and dark branches of each of the four pixels is maximized. The curves correspond to a 5-column LUT in which for each target level, the digital pixel levels of each of the four pixels in the 2×2 block are specified. The order in which the four pixels are sequentially turned brighter or darker is determined by the pattern generation portion of the algorithm. This can be done by defining the four pixel locations in each 2×2 quad block as locations A,B,C, and D, as shown in Table 2.

TABLE 2

| Pixel locations within each 2 × 2 quad block. | |
|---|---|
| A | B |
| C | D |

Different patterns can be generated by specifying the order in which the subpixels within the quad block are turned on. As the target pixel level is increased from 0 to 255, for the individual red, green, or blue subpixels, charts showing the order in which the subpixels are turned on are given in Table 3 and Table 4. These turn-on sequences result in patterns which do not exhibit flicker, following the criteria discussed previously. Table 3 defines how the 2×2 subpixel pattern may be generated, and Table 4 defines how the 4×2 double subpixel pattern may be generated. For example, the turn-on sequence for the red subpixels in the 2×2 subpixel pattern alternates between D,C,B,A and C,D,A,B for quad blocks in horizontal sequence. The turn-on sequence for the red subpixels in the 4×2 double subpixel pattern alternates between C,B,A,D and A,D,C,B for quad blocks in horizontal sequence.

TABLE 3

Subpixel turn-on sequence to generate a 2 × 2 subpixel pattern.

| location | A | B | C | D | A | B | C | D |
|---|---|---|---|---|---|---|---|---|
| RED | 4 | 3 | 2 | 1 | 3 | 4 | 1 | 2 |
| GREEN | 1 | 2 | 3 | 4 | 2 | 1 | 4 | 3 |
| BLUE | 4 | 3 | 2 | 1 | 3 | 4 | 1 | 2 |

TABLE 4

Subpixel turn-on sequence to generate a 4 × 2 double subpixel pattern.

| location | A | B | C | D | A | B | C | D |
|---|---|---|---|---|---|---|---|---|
| RED | 3 | 2 | 1 | 4 | 1 | 4 | 3 | 2 |
| GREEN | 4 | 3 | 2 | 1 | 2 | 1 | 4 | 3 |
| BLUE | 1 | 4 | 3 | 2 | 3 | 2 | 1 | 4 |

Figure 31:
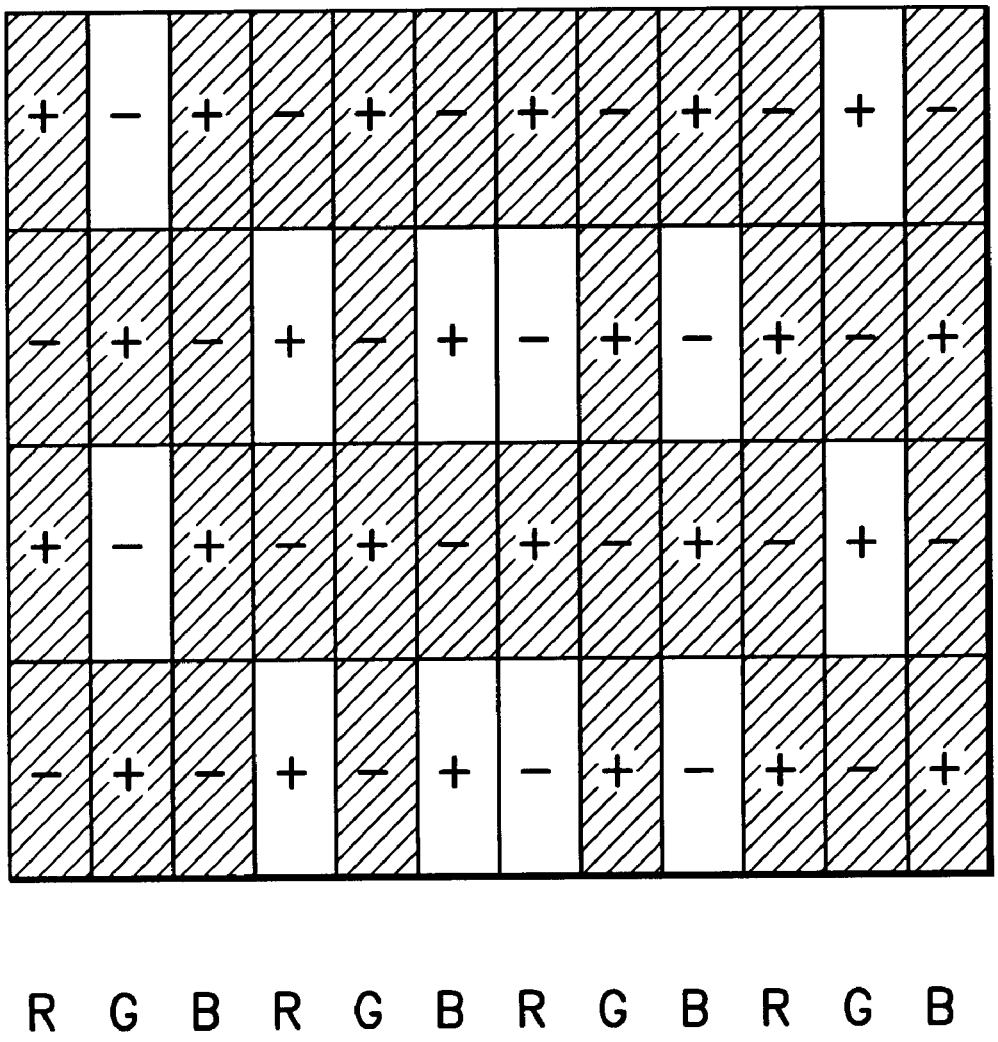
FIG. 31 is an illustration of a 2×2 subpixel-like pattern for 25% luminance using quad pixel processing.
Figure 32:
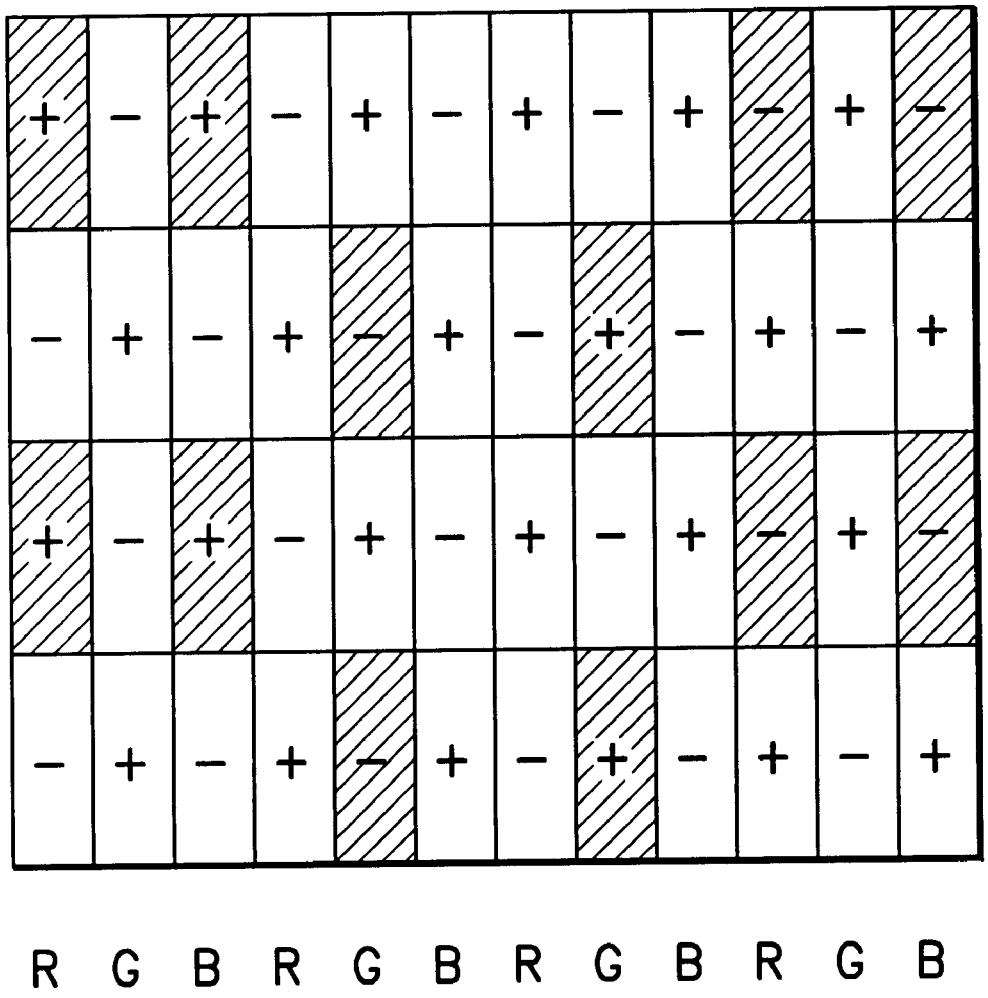
FIG. 32 is an illustration of a 2×2 subpixel-like pattern for 75% luminance using quad pixel processing.
Figure 33:
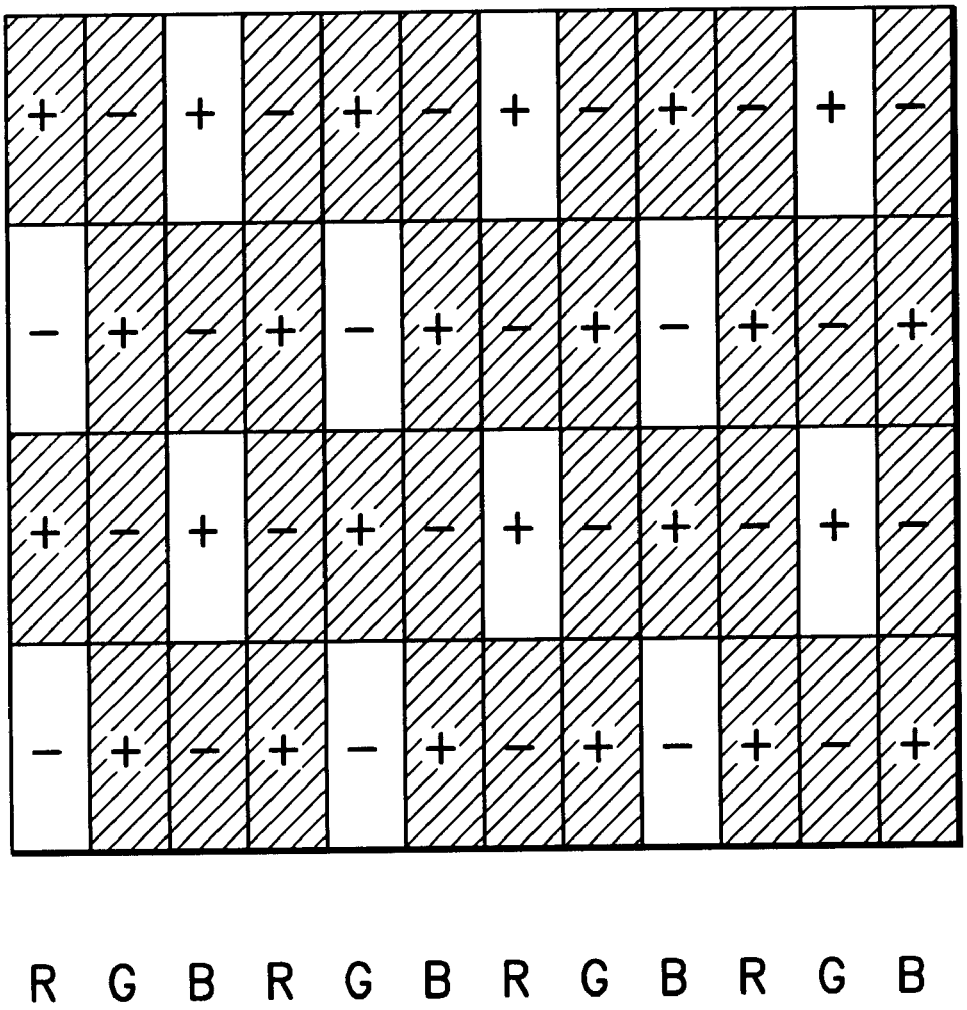
FIG. 33 is an illustration of a 4×2 double subpixel-like pattern for 25% luminance using quad pixel processing.
Figure 34:
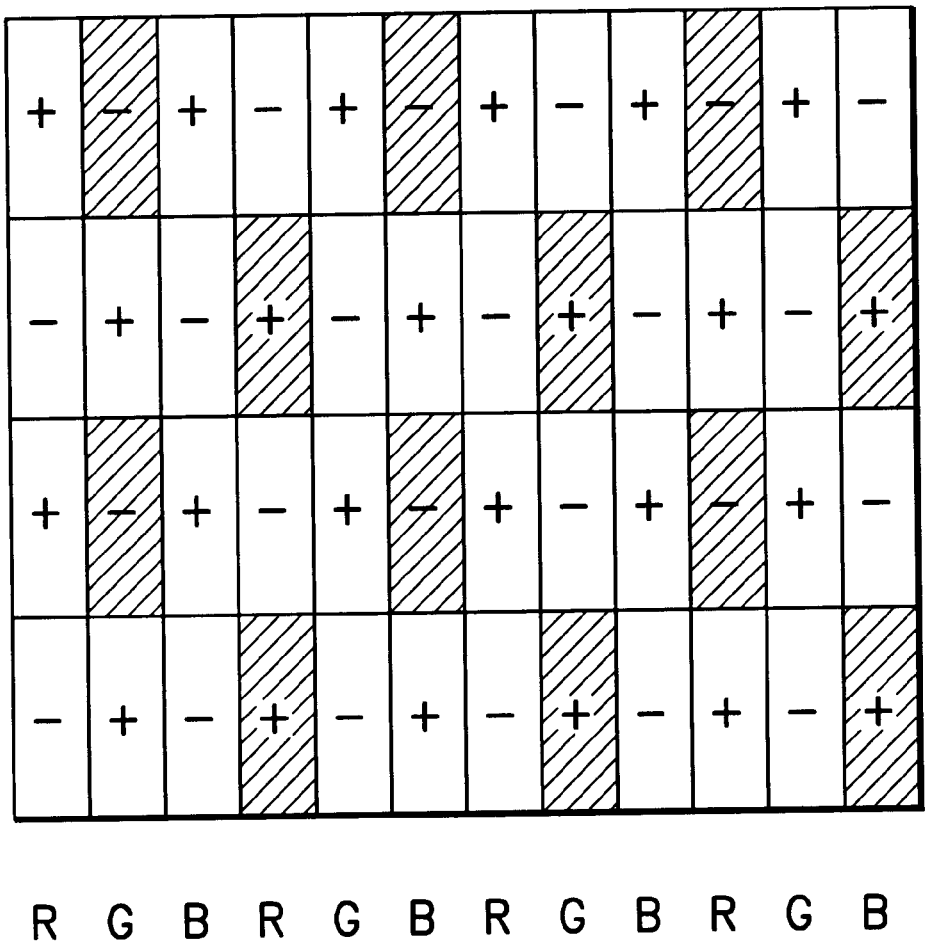
FIG. 34 is an illustration of a 4×2 double subpixel-like pattern for 25% luminance using quad pixel processing.

At 50% target luminance the subpixel patterns generated with this process match the 2×2 subpixel pattern shown in FIG. 19 and the 4×2 double subpixel pattern shown in FIG. 18. Examples of the 2×2 subpixel pattern at 25% and 75% target luminance are shown in FIG. 31 and FIG. 32. Strictly speaking, the patterns at 25% and 75% do not have perfect 2×2 subpixel symmetry as for the 50% luminance pattern, but they do maintain the same color character of this pattern. Examples of the 4×2 double subpixel pattern at 25% and 75% luminance are shown in FIG. 33 and FIG. 34. In similar fashion, these patterns do not possess perfect 4×2 double subpixel symmetry, but they do maintain the same color character of this pattern.

For the technique applied in 2×2 blocks, as the luminance decreases from maximum to minimum, the shifts in color and in viewing angle characteristics are about one half that exhibited by the technique applied to pairs of pixels. This is a consequence of reducing the target luminance range spanned by each pixel by a factor of two. For pairwise pixel processing, as each pixel within the pair traverses luminance from bright to dark, the target average luminance changes by 50%. For quad pixel processing, as each pixel within the block traverses luminance from bright to dark, the target average luminance changes by 25%. In this way, the excursion of the peak luminance from normal incidence (as shown in FIG. 29) can be reduced by about one half, with corresponding improvement in viewing angle characteristics.

From the earlier discussion regarding refinements in the algorithm for pairwise pixel processing, it should be recognized that further improvements in the appearance of the patterns resulting from quad pixel processing can also be achieved by appropriate smoothing or other modification of the curves illustrated in FIG. 30. For example, as the target luminance is increased, it is not necessary to fully turn on one pixel within the quad block before another pixel is turned on. In this way, the four curves shown in FIG. 30 can overlap, which will ameliorate the abrupt color and luminance changes which might otherwise occur near the boundaries of the four curves.

For certain conditions met by the image data, it is necessary to turn off the halftone algorithm process. For example, if a portion of the image is black text on a white background, the halftone algorithm can be turned off by detecting the presence of a subpixel with level 255 or 0. For processing of subpixel pairs, if either subpixel has a value of 0 or 255, then no modification is made to the subpixel data. Text or other portions of the image which contain fully saturated subpixels are not halftoned, and the local contrast between subpixels is preserved. Other criteria can be introduced, by testing for the presence of antialiasing or font smoothing. In this way, the high contrast of letters can be preserved, and blocks of graphical images which contain saturated color can also be preserved.

The present invention can be realized in hardware, software, or a combination of hardware and software. A preferred embodiment of this invention is implemented in hardware entirely within the data processing portion of the controller electronics within the display module. However, to one skilled in the art, it is clear that this invention can be implemented within the display subsystem hardware, operating system software or within the application software.

The present invention can be realized in a centralized fashion in one computer system, or in a distributed fashion where different elements are spread across several interconnected computer systems. Any kind of computer system—or other apparatus adapted for carrying out the invention described herein—is suited. A typical combination of hardware and software could be a general purpose computer system with a computer program that, when being loaded and executed, controls the computer system such that it carries out the methods described herein. The present invention can also be embedded in a computer program product, which comprises all the features enabling the implementation of the methods described herein, and which—when loaded in a computer system—is able to carry out these methods.

Computer program means or computer program in the present context means any expression, in any language, code or notation, of a set of instructions intended to cause a system having an information processing capability to perform a particular function either directly or after either or both of the following a) conversion to another language, code or notation; b) reproduction in a different material form.

While the invention has been particularly shown and described with respect to illustrative and preferred embodiments thereof, it will be understood by those skilled in the art that the foregoing and other changes in form and detail may be made therein without departing from the spirit and scope of the invention as set forth in the claims.

We claim:

1. A method for generating an image for display on a display device having a plurality of subpixels, the method comprising the steps of:

Providing, in digital form, luminance data which associates intensity values with corresponding luminance values characterizing luminance of said subpixels in at least one viewing angle direction for a range of said intensity values;

providing a group of subpixel data elements representing color of a portion of said image, wherein each of said subpixel data elements comprises an intensity value;

modifying said intensity values for said subpixel data elements in said group based upon said luminance data to reduce the number of said subpixels that have a luminance value in a range of mid-tone luminance values between a bright luminance value and a dark luminance value; and outputting said modified intensity values for said subpixel data elements of said group for display on said display device, wherein said modifying step further comprises:

reducing perceptible variance in one of luminance and color over different viewing angles with respect to the display of the image;

evaluating said subpixel data elements for satisfaction of a set of predetermined criteria;

modifying said intensity values if said criteria are not satisfied; and maintaining said intensity values if said criteria are satisfied.

2. The method of claim 1, wherein the modifying step further comprises the sub-steps of:

storing, in a first memory, a plurality of entries each providing an association between an intensity value and a corresponding luminance value characterizing luminance of said subpixels in at least one viewing angle direction;

storing, in a second memory, a plurality of entries each providing an association between a target intensity value and a corresponding set of intensity values that are above and below said target intensity value;

identifying particular luminance values stored in said first memory that correspond to intensity values of said subpixel data elements of said group;

generating a first luminance value based upon the particular luminance values stored in said first memory;

identifying a first target intensity value stored in said first memory corresponding to said first luminance value;

identifying a particular set of intensity values stored in said second memory that correspond to said first target intensity value; and modifying intensity values for said subpixel data elements in said group based upon said particular set of intensity values.

3. The method of claim 1, further comprising the steps of:

performing a digital-to-analog conversion that converts the modified intensity values for said subpixel data elements of said group from digital form to data signals in analog form; and supplying the data signals in analog form to subpixels of the display device for displaying the portion of the image represented by said subpixel data elements of said group.

4. The method of claim 3, wherein circuitry integral to the display device performs said digital-to-analog conversion and supplies the data signals in analog form to subpixels of the display device.

5. The method of claim 1, wherein display logic of a display subsystem operatively coupled to said display device:

provides said luminance data in digital form;

provides said group of subpixel data elements representing color of a portion of said image;

modifies said intensity values for said subpixel data elements in said group based upon said luminance data; and outputs said modified intensity values for said subpixel data elements of said group for display on said display device.

6. The method of claim 1, wherein each step is performed by application software executing on a computer system.

7. The method of claim 1, wherein said subpixel data elements representing said image are logically partitioned into an array of rows and columns.

8. The method of claim 7, wherein said group of subpixel data elements comprise a pair of data elements in one of the rows of the array.

9. The method of claim 7, wherein said group of subpixel data elements comprise a pair of data elements in one of the columns of the array.

10. The method of claim 7, wherein said group of subpixel data elements are elements of full pixels which comprise a 2×2 quad block of data elements in the array.

11. A programmable storage device readable by a digital processing apparatus and tangibly embodying a program of instructions executable by the digital processing apparatus to perform method steps for generating an image for display on a display device having a plurality of subpixels, the method steps comprising:

providing luminance data, in digital form, which associates intensity values with corresponding luminance values characterizing luminance of said subpixels in at least one viewing angle direction for a range of said intensity values;

providing a group of subpixel data elements representing color of a portion of said image, wherein each of said subpixel data elements comprises an intensity value;

modifying said intensity values for said subpixel data elements in said group based upon said luminance data to reduce the number of said subpixels that have a luminance value in a range of mid-tone luminance values between a bright luminance value and a dark luminance value; and outputting said modified intensity values for said subpixel data elements of said group for display on said display device, wherein the modifying step further comprises the sub-steps of:

storing, in a first memory, a plurality of entries each providing an association between an intensity value and a corresponding luminance value characterizing luminance of said subpixels in at least one viewing angle direction;

storing, in a second memory, a plurality of entries each providing an association between a target intensity value and a corresponding set of intensity values that are above and below said target intensity value;

identifying particular luminance values stored in said first memory that correspond to intensity values of said subpixel data elements of said group;

generating a first luminance value based upon the particular luminance values stored in said first memory;

identifying a first target intensity value stored in said first memory corresponding to said first luminance value;

identifying a particular set of intensity values stored in said second memory that correspond to said first target intensity value; and modifying intensity values for said subpixel data elements in said group based upon said particular set of intensity values.

12. The programmable storage device of claim 11, wherein said subpixel data elements in said group are elements of full pixels which are adjacent to each other in said image.

13. The programmable storage device of claim 11, wherein said first luminance value is derived by calculating an average luminance value of the particular luminance values stored in the first memory.

14. An apparatus for generating an image for display on a display device having a plurality of subpixels comprising:

a first memory wherein luminance data, in digital form, which associates intensity values with corresponding luminance values characterizing luminance of said subpixels in at least one viewing angle direction for a range of intensity values, are stored;

a second memory wherein a group of subpixel data elements representing color of a portion of said image are stored, wherein said subpixel data elements are logically partitioned into rows and columns and each of said subpixel data elements comprises an intensity value; and an intensity controller which modifies said intensity values for said subpixel data elements in said group based upon said luminance data to reduce the number of said subpixels that have a luminance value in a range of mid-tone luminance values between a bright luminance value and a dark luminance value, wherein said subpixels corresponding to said modified intensity values are arranged in pairs of subpixels, wherein for each pair of subpixels, the luminance of a first subpixel of said pair of subpixels is brighter than the average luminance of said pair of subpixels and the luminance of a second subpixel of said pair of subpixels is darker than the average luminance of said pair of subpixels, and a pixel pattern has a periodicity of one of 2 full pixels along said rows and 2 full pixels along said columns, 2 full pixels along said rows and 4 full pixels along said columns, or 4 full pixels along said rows and 2 full pixels along said columns, wherein said pair of subpixels are elements of full pixels which are adjacent to each other in said image.

15. A computer, comprising:

a display device which displays an image; and a processor which provides data to said display device, wherein said data is configured to control said display device in order to display said image, and wherein said data is configured so that said image is displayed as:

a plurality of subpixels logically partitioned into a first category and a second category, wherein:

the first category of subpixels are supplied with a data signal of a first polarity, the second category of subpixels are supplied with a data signal of a second polarity opposite said first polarity, and the subpixels are partitioned to reduce perceived flicker in the displayed image; and wherein:

the subpixels correspond to data elements representing color of at least a portion of said image, each of said data elements comprises an intensity value, said data elements representing said image are logically partitioned into rows and columns, each of said subpixels corresponds to a data element representing a particular color in a group of two or more colors, a full pixel comprises subpixels corresponding to the colors of said group, said intensity values have been modified to reduce the number of said data elements having a luminance value corresponding to said intensity value in a range of mid-tone luminance values between a bright luminance value and a dark luminance value, said subpixels corresponding to said modified intensity values are arranged in pairs of subpixels, wherein for each pair of subpixels, the luminance of a first subpixel of said pair of subpixels is brighter than the average luminance of said pair of subpixels and the luminance of a second subpixel of said pair of subpixels is darker than the average luminance of said pair of subpixels, and a pixel pattern has a periodicity of 2 full pixels along said rows and 2 full pixels alone said columns, wherein said pair of subpixels are elements of full pixels which are adjacent to each other in said image and wherein for each full pixel comprising subpixels corresponding to said modified intensity values, said subpixels comprising said full pixel are one of said second subpixels of said pair of subpixels and said first subpixels of said pair of subpixels.

16. A method for generating an image for display on a display device having a plurality of subpixels, the method comprising the steps of:

Providing, in digital form, luminance data which associates intensity values with corresponding luminance values characterizing luminance of said subpixels in at least one viewing angle direction for a range of said intensity values;

providing a group of subpixel data elements representing color of a portion of said image, wherein each of said subpixel data elements comprises an intensity value;

modifying said intensity values for said subpixel data elements in said group based upon said luminance data to reduce the number of said subpixels that have a luminance value in a range of mid-tone luminance values between a bright luminance value and a dark luminance value; and outputting said modified intensity values for said subpixel data elements of said group for display on said display device, wherein the modifying step further comprises the sub-steps of:

storing, in a first memory a plurally of entries each providing an association between an intensity value and a corresponding luminance value characterizing luminance of said subpixels in at least one viewing angle direction;

storing, in a second memory, a plurality of entries each providing an association between a target intensity value and a corresponding set of intensity values that are above and below said target intensity value;

identifying particular luminance values stored in said first memory that correspond to intensity values of said subpixel data elements of said group;

generating a first luminance value based upon the particular luminance values stored in said first memory;

identifying a first target intensity value stored in said first memory corresponding to said first luminance value;

identifying a particular set of intensity values stored in said second memory that correspond to said first target intensity value; and modifying intensity values for said subpixel data elements in said group based upon said particular set of intensity values.

17. The method of claim 16, wherein said subpixel data elements in said group are elements of fill pixels which are adjacent to each other in said image.

18. The method of claim 16, wherein the modifying step further comprises the step of:

setting intensity values for said subpixel data elements in said group to said particular set of intensity values.

19. The method of claim 16, wherein said first luminance value is derived by calculating an average luminance value of the particular luminance values stored in the first memory.

20. The method of claim 16, wherein said modifying step further comprises reducing perceptible variance in luminance over different viewing angles with respect to the display of the image.

21. The method of claim 16, wherein said modifying step further comprises reducing perceptible variance in color over different viewing angles with respect to the display of the image.

22. A computer, comprising:

a display device which displays an image; and a processor which provides data to said display device, wherein said data is configured to control said display device in order to display said image, and wherein said data is configured so that said image is displayed as:

a plurality of subpixels logically partitioned into a first category and a second category, wherein:

the first category of subpixels are supplied with a data signal of a first polarity, the second category of subpixels are supplied with a data signal of a second polarity opposite said first polarity, and the subpixels are partitioned to reduce perceived flicker in the displayed image; and wherein:

the subpixels correspond to data elements representing color of at least a portion of said image, each of said data elements comprises an intensity value, said data elements representing said image are logically partitioned into rows and columns, each of said subpixels corresponds to a data element representing a particular color in a group of two or more colors, a full pixel comprises subpixels corresponding to the colors of said group, said intensity values have been modified to reduce the number of said data elements having a luminance value corresponding to said intensity value in a range of mid-tone luminance values between a bright luminance value and a dark luminance value, said subpixels corresponding to said modified intensity values are arranged in pairs of subpixels, wherein for each pair of subpixels, the luminance of a first subpixel of said pair of subpixels is brighter than the average luminance of said pair of subpixels and the luminance of a second subpixel of said pair of subpixels is darker than the average luminance of said pair of subpixels, and a pixel pattern has a periodicity of one of 2 full pixels along said rows and 4 full pixels along said columns or 4 full pixels along said rows and 2 full pixels along said columns, wherein said pair of subpixels are elements of full pixels which are adjacent to each other in said image.

23. The computer of claim 22, wherein for each full pixel comprising subpixels corresponding to said modified intensity values, said subpixels comprising said full pixel are one of said second subpixels of said pair of subpixels and said first subpixels of said pair of subpixels.

24. The computer of claim 22, wherein said subpixels corresponding to said modified intensity values are arranged in adjacent couples comprising one of said second subpixels of said pair of subpixels and said first subpixels of said pair of subpixels.

25. A computer, comprising:

a display device which displays an image; and a processor which provides data to said display device, wherein said data is configured to control said display device in order to display said image, and wherein said data is configured so that said image is displayed as:

a plurality of subpixels logically partitioned into a first category and a second category, wherein:

the first category of subpixels are supplied with a data signal of a first polarity, the second category of subpixels are supplied with a data signal of a second polarity opposite said first polarity, and the subpixels are partitioned to reduce perceived flicker in the displayed image; and wherein the subpixels correspond to data elements representing color of at least a portion of said image, each of said data elements comprises an intensity value, said data elements representing said image are logically partitioned into rows and columns, each of said subpixels corresponds to a data element representing a particular color in a group of two or more colors, a full pixel comprises subpixels corresponding to the colors of said group, said intensity values have been modified to reduce the number of said data elements having a luminance value corresponding to said intensity value in a range of mid-tone luminance values between a bright luminance value and a dark luminance value, said subpixels corresponding to said modified intensity values are arranged in pairs of subpixels, wherein for each pair of subpixels, the luminance of a first subpixel of said pair of subpixels is brighter than the average luminance of said pair of subpixels and the luminance of a second subpixel of said pair of subpixels is darker than the average luminance of said pair of subpixels, and a pixel pattern has a periodicity of 2 full pixels along said rows and 2 subpixels along said columns, and wherein said subpixels are arranged in rows alternating between a first row of adjacent couples comprising said first subpixels of said pair of subpixels, separated by one of said second subpixels of said pair of subpixels and a second row of adjacent couples comprising said second subpixels of said pair of subpixels, separated by one of said first subpixels of said pair of subpixels.

26. The computer of claim 25, wherein said first and second rows comprise adjacent couples of blue and red subpixels separated by one green subpixel.

27. The computer of claim 25, wherein said first and second rows comprise adjacent couples of blue and green subpixels separated by one red subpixel.

28. The computer of claim 25, wherein said first and second rows comprise adjacent couples of green and red subpixels separated by one blue subpixel.

* * * * *